US010065220B2

(12) United States Patent
Flury et al.

(10) Patent No.: US 10,065,220 B2
(45) Date of Patent: Sep. 4, 2018

(54) METHOD AND DEVICE FOR CLEANING INTERIORS OF TANKS AND SYSTEMS

(71) Applicant: Bang & Clean GmbH, Remetschwil (CH)

(72) Inventors: Rainer Flury, Schliern bei Koniz (CH); Markus Bürgin, Remetschwill (CH)

(73) Assignee: BANG & CLEAN GMBH, Remetschwil (CH)

( * ) Notice: Subject to any disclaimer, the term of this patent is extended or adjusted under 35 U.S.C. 154(b) by 0 days.

(21) Appl. No.: 14/766,194

(22) PCT Filed: Feb. 11, 2014

(86) PCT No.: PCT/CH2014/000018
§ 371 (c)(1),
(2) Date: Aug. 6, 2015

(87) PCT Pub. No.: WO2014/121409
PCT Pub. Date: Aug. 14, 2014

(65) Prior Publication Data

US 2015/0375274 A1 Dec. 31, 2015

(30) Foreign Application Priority Data

Feb. 11, 2013 (CH) ..... 0429/13

(51) Int. Cl.
*B08B 7/00* (2006.01)
*F22B 37/54* (2006.01)
*F28G 1/00* (2006.01)

(52) U.S. Cl.
CPC ..... *B08B 7/0007* (2013.01); *F22B 37/54* (2013.01); *F28G 1/00* (2013.01)

(58) Field of Classification Search
CPC ..... F28G 1/10; B08B 7/007; F22B 37/54
See application file for complete search history.

(56) References Cited

U.S. PATENT DOCUMENTS 6,684,791 B1 * 2/2004 Barnhart ..... F42B 3/00 102/307
6,935,281 B2 8/2005 Ruegg
7,267,134 B2 * 9/2007 Hochstein, Jr. ..... B08B 7/0007 122/379

(Continued)

FOREIGN PATENT DOCUMENTS

CN 2424423 3/2001
CN 1514925 7/2004

(Continued)

OTHER PUBLICATIONS

English translation of Chinese Office Action dated Feb. 28, 2018, Application No. 201480020990.3, 17 pages.

*Primary Examiner* — Bibi Sharidan Carrillo
(74) *Attorney, Agent, or Firm* — Rankin, Hill & Clark LLP

(57) ABSTRACT

A method and a cleaning device for removing deposits in interiors of tanks and systems by explosion technology. The cleaning device, an explosive, gaseous mixture is provided and caused to explode in order to clean the interior. The explosion pressure wave is conducted into the interior via an outlet opening in the cleaning device. The explosive mixture or gaseous components thereof are introduced into an accommodating chamber of the cleaning device from pressure vessels at high velocity.

10 Claims, 7 Drawing Sheets

(56) References Cited

U.S. PATENT DOCUMENTS

| | | | | |
|---|---|---|---|---|
| 2004/0112306 | A1* | 6/2004 | Ruegg | F27D 25/006 122/393 |
| 2009/0320439 | A1 | 12/2009 | Chapin et al. | |
| 2012/0111375 | A1 | 5/2012 | Ass et al. | |
| 2014/0138078 | A1* | 5/2014 | Lerbrekk | E21B 33/13 166/55 |

FOREIGN PATENT DOCUMENTS

| | | | |
|---|---|---|---|
| CN | 101290133 | | 10/2008 |
| CN | 101590479 | | 12/2009 |
| CN | 102444896 | | 5/2012 |
| DE | WO2013/082731 | A1 * | 6/2013 |
| DE | WO2013082730 | A1 * | 6/2013 |
| EP | 1 067 349 | | 1/2001 |
| EP | 1 362 213 | | 11/2003 |
| EP | 1 987 895 | | 11/2008 |
| GB | 2478831 | | 9/2011 |
| JP | 57-144816 | | 9/1982 |
| JP | 1-150710 | | 6/1989 |
| JP | 11-118135 | | 4/1999 |
| JP | 2003-320331 | | 11/2003 |
| RU | 2 280 516 | | 7/2006 |

* cited by examiner

Fig. 4
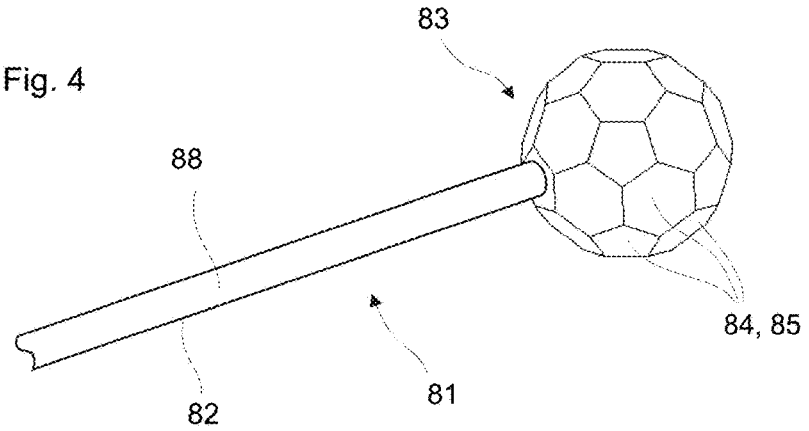
Fig.18
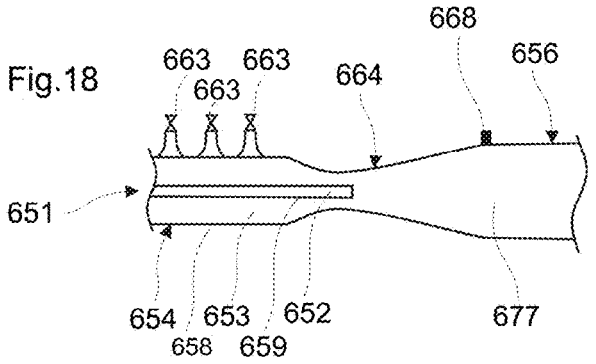
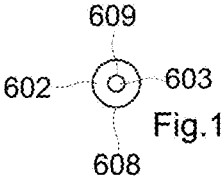
Fig.19b
Fig.19a
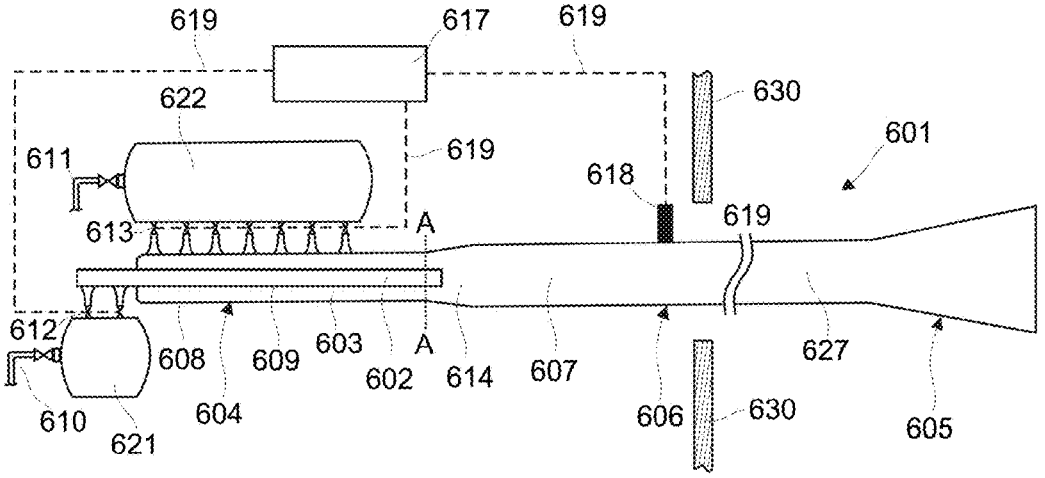

Fig. 8a
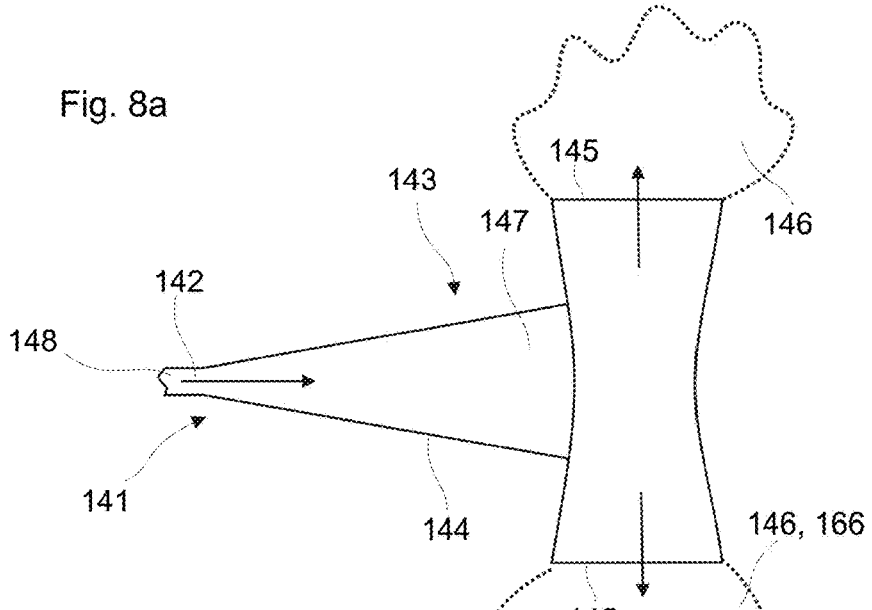
Fig. 8b
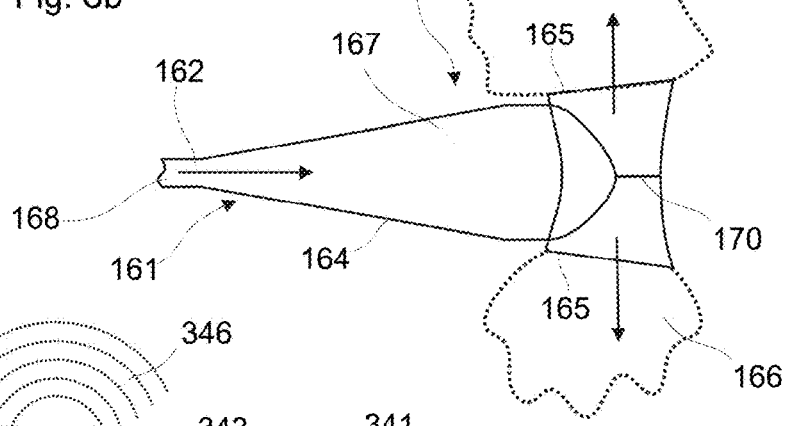
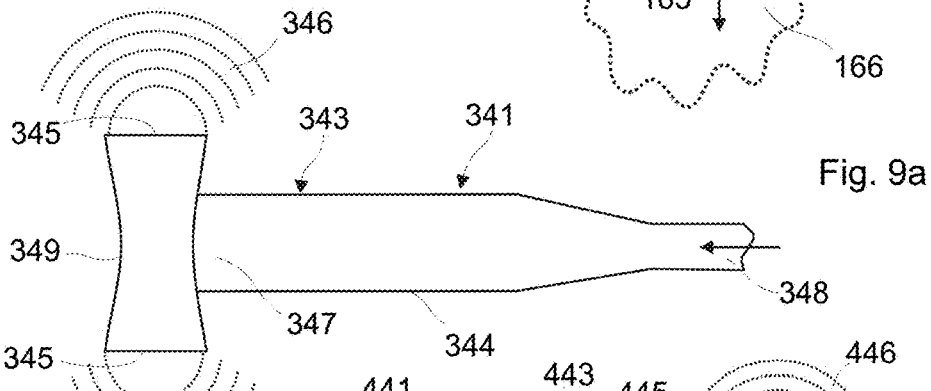
Fig. 9a
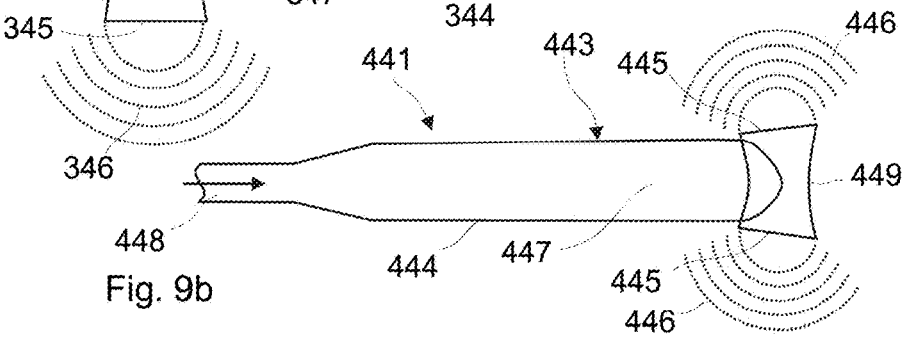
Fig. 9b

METHOD AND DEVICE FOR CLEANING INTERIORS OF TANKS AND SYSTEMS

BACKGROUND OF THE INVENTION

Field of the Invention

The present invention generally relates to the field of cleaning interiors of receptacles (tanks) and installations, and to a method and a cleaning device for removing deposits in interiors of receptacles and installations by way of explosion technology. More particularly, the method and the device serve for cleaning dirty and slagged receptacles and installations with caking on their inner walls, in particular of incineration installations.

Description of Related Art

Heating surfaces, e.g. of waste incineration plants or generally combustion boilers are generally exposed to large contamination or fouling. This fouling has inorganic compositions and typically arises due to deposits of ash particles on the wall. Coatings in the region of high flue gas temperatures are mostly very hard, since they remain stuck to the wall in either molten form or are melted on the wall or are stuck together by way of substances melting or condensing at a lower temperature, when solidifying on the colder boiler wall. Such coatings are very difficult to remove and are inadequately removed by way of known cleaning methods. This leads to the boiler having to be periodically taken out of service and cooled. For this, the construction of a scaffold in the furnace or kiln is often necessary, since such boilers usually have extremely large dimensions. This moreover requires an operational interruption of several days or weeks and is extremely unpleasant and unhealthy for the cleaning personnel due to the large occurrence of dust and dirt. One consequence, which mostly inherently occurs with an operational interruption of an installation, is damage to the receptacle materials themselves as a result of the large temperature changes. The installation standstill costs due to the production or income losses are an important cost factor, additionally to the cleaning and repair costs.

Conventional cleaning methods, which are used when the installations are shut down, for example, are boiler beating, as well as the use of steam jet blasters, water jet blasters/soot blasters or shot-cleaning as well as sand blasting.

Moreover, a cleaning method is known, with which the cooled-down tanks or the hot tanks that are in operation are cleaned by way of introducing and igniting explosive bodies. With the method described in the document EP 1 067 349, a cooled explosive body is brought by way of a cooled lance into the proximity of the fouled heat surface, where the explosive charge is ignited. The heat surface caking is blown away due to the impact of the detonation, as well as due to the wall oscillations produced by the shock waves. The cleaning time can be significantly shortened with this method in comparison to the convention cleaning methods. With the necessary safety precautions, the cleaning can take place during the operation of the incineration or combustion furnace, which is to say still in the hot condition of the receptacle or container. Thus, it is possible to clean a tank in this manner within hours and without an operational interruption, for which conventional cleaning methods require days.

The disadvantage with the method described in EP 1 067 349 is the necessity for explosives. Apart from the high costs for the explosive material, a huge expense with regard to safety must be met, for example with the storage of the explosive, in order to avoid accidents or theft. The introduction of explosive material into a hot container moreover necessitates an absolutely reliable and efficient cooling system, in order to prevent a premature detonation of the explosive.

A further cleaning method is known from EP 1 362 213 B1, which likewise makes use of means for the production of an explosion. Instead of explosive, according to this method however, a container envelope, which is inflatable with an explosive gas mixture, is attached onto the end of a cleaning lance. The cleaning lance together with the empty container envelope is introduced into the boiler space and is positioned in the proximity of the location to be cleaned. Subsequently, the container envelope is inflated with an explosive gas mixture. An explosion is produced by way of igniting the gas mixture in the container envelope, and the shock waves of this explosion lead to the detachment of fouling on the boiler walls. The container envelope is shredded and combusted by way of the explosion. It therefore represents a consumable material.

This method and the associated device, compared to the explosive technology with explosive and which is mentioned above, has the advantage that the method is favourable with regard to operation. Thus, for example, the starting components of a gas mixture that comprises oxygen and a combustible gas are inexpensive in procurement in comparison to explosives. Moreover, the procurement and handling of the mentioned gases, in contrast to explosives, requires no special permits or qualifications, so that anyone who has accomplished a corresponding training is capable of carrying out the method.

Moreover, it is also advantageous that the starting components are led via separate feed conduits of the cleaning lance and that the dangerous explosive mixture is therefore not created in the cleaning lance until shortly before triggering the explosion. In comparison to explosives, the handling of the individual components of the gas mixture is indeed far less dangerous, since the individual components, at the most are combustible, but are not explosive.

The associated method has the disadvantage that the handling of the container envelope is quite cumbersome. Thus, a container envelope must be fastened via the exit opening of the cleaning device in each case for each cleaning procedure. This process is also quite time-consuming, so that the individual cleaning procedures each take up comparatively much time.

Moreover, the filling procedure is also comparatively slow. This is due to the fact that the explosive mixture can only be admitted into the container envelope at a relatively low filling speed, so that this container envelope can unfold and expand in a controlled manner, without damage to the envelope occurring. If specifically the explosive mixture is admitted into the container envelope at a high speed, then this container envelope is drawn together and does not expand due to the produced vacuum. Moreover, individual layers of the container envelope can be peeled away at the inner side.

Furthermore, the expanded container envelope cannot be inserted into narrow regions, as are present in the case of bundles of pipes for example. This means that the explosive mixture cannot be brought into the narrow regions to be cleaned, and be made to explode there, on location. In contrast, the explosive mixture can only be ignited from outside these regions, wherein the explosion waves that penetrate into the narrow or restricted regions result in a limited cleaning effect.

Moreover, one must permanently ensure a resupply of consumed material in the form of container envelopes. The consumed material moreover represents an additional cost factor. Thus the container envelopes as a rule must be hand-crafted, which is accordingly expensive.

Furthermore, residues arise with the use of container envelopes and these are not completely combusted by the explosion. These residues can compromise the operation of the installation to be cleaned.

SUMMARY OF THE INVENTION

It is therefore the object of the present invention, to modify the cleaning devices and methods known in the art to the extent that a targeted and even improved cleaning effect can be achieved. In particular, narrow regions are also to be accessible to the explosive mixture.

According to a further object, the implementation of the method is to be less cumbersome and less time-consuming as well as more economical.

According to a further object, as little as possible residues should occur when carrying out the cleaning method.

The cleaning method according to the present invention is based on bringing an explosive mixture into the proximity of a location to be cleaned, in order to subsequently bring to mixture to explode.

The explosive mixture is gaseous at least in the explosive condition.

According to a first variant, the explosive mixture can be formed from a gaseous component, which is introduced into the cleaning apparatus. This means that the introduced gaseous component already forms the explosive, gaseous mixture.

According to a second variant, the explosive mixture can be formed from two or more and in particular of two gaseous components which are to be introduced separately into the cleaning apparatus. The gaseous components are mixed with one another into an explosive, gaseous mixture in a mixing zone, in the cleaning apparatus. The mixing zone in particular is arranged in front of or in the feed pressure conduit.

Gaseous components means that these are present in a gaseous manner on forming the explosive mixture in the receiving space and in particular already on introduction into the cleaning apparatus. The gaseous components, also called starting components, can however also be present in liquid form under pressure in pressure containers (tanks). The gaseous components in particular can be a rapidly evaporating liquid.

The explosive mixture in particular comprises a fuel as well as an oxidant, such as, for example, gaseous oxygen or a gas containing oxygen. The fuel can be liquid or gaseous. This, for example, can be from the group of combustible hydrocarbons such as acetylene, ethylene, methane, ethane, propane, benzene/petrol, oil etc. Thus, a first gaseous component is a fuel and a second gaseous component the oxidant.

The explosive mixture in particular is made ready in the receiving space of the cleaning apparatus.

The mixture in particular is ignited via an ignition device for triggering the explosion.

The impact of the explosion and the surface, for example a container wall or pipe wall, which is brought into oscillation by the shock waves, effect the blasting-away of the wall caking and slag and thus the cleaning of the surface.

The strength of the explosion necessary for a cleaning and, thus, the quantity of the applied gaseous components for producing the explosive mixture is directed to the type of fouling and to the size and type of the fouled receptacle. The metering and strength of the explosion can and are preferably selected such that no damage to the installations occurs. The possibility of the optimal metering of the applied substances on the one hand reduces the cleaning costs, and on the other hand reduces the danger and damage risks to the installation and persons.

The cleaning apparatus in particular comprises a feed pressure conduit, also called supply conduit, through which the explosive mixture is led to an outlet opening.

The feed pressure conduit in particular forms a closed feed pressure channel, also called supply channel. This can form a circular cross section and have a diameter of 150 mm (millimeters) or less, or of 100 mm or less, or of 60 mm or less and in particular of 55 mm or less. The diameter can moreover be 20 mm or larger, or 30 mm or larger, in particular 40 mm or more.

The length of the feed pressure conduit can, for example, be 1 m (meter) or more, or 2 m or more, or 3 m or more, or 4 m or more.

The cleaning apparatus in particular comprises an outlet device that includes the outlet opening. The outlet device in particular is arranged subsequently to the feed pressure conduit in the outflow direction.

In particular, the outlet device forms a receiving space for receiving at least a part of the fed explosive mixture. In particular, the feed pressure conduit and the outlet device form a receiving space for receiving at least a part of the fed explosive mixture.

The receiving space in particular is open to the outside via the outlet opening.

The explosive mixture is made to explode in the receiving space, in particular in the pressure feed conduit. The pressure wave of the explosion propagates through the outlet (exit) opening into the interior of the installation or the receptacle.

Such a method with the associated device for example can be applied, for example, for cleaning catalysers in flue gas cleaning installations. The explosion pressure waves exiting through the outlet opening of the cleaning apparatus thereby act upon the catalyser and detach fouling/deposits.

The outlet opening is open to the outside during the ignition and explosion of the explosive mixture.

The outlet opening is open to the outside in particular during the ignition and explosion of the explosive mixture. The outlet opening in particular is open to the outside during the introduction of the explosive mixture into the receiving space.

The outlet opening in particular is open to the outside during a complete cleaning cycle, comprising the introduction of an explosive mixture and the ignition and explosion of the explosive mixture. The outlet opening in particular can be non-closable.

The total volume of explosive mixture is formed at least by the volume of explosive mixture in the receiving space.

The outlet opening can optionally be closed during the introduction of the explosive mixture into the receiving space. The outlet opening can be closed by way of a cover. The cover can be mounted (assembled). The cover can be flexible or rigid. The cover can be of plastic. The cover can be plate-like. The cover can be designed such that the cover is destroyed by the explosion of the explosive mixture and thus releases the path outwards through the outlet opening for the explosion pressure wave. The total volume of explosive mixture here is formed exclusively by the volume of explosive mixture in the receiving space.

According to a further aspect of the invention, at least a part of the introduced explosive mixture is introduced via the outlet opening of the cleaning apparatus into the interior of the receptacle or installation. Thereby, a cloud of the explosive mixture is formed in the interior. This cloud is made to explode.

In the present case, the total volume of explosive mixture comprises the volume of explosive mixture in the receiving space of the cleaning apparatus and the volume of the cloud of explosive mixture that is formed outside of the cleaning apparatus.

The cloud in particular is characterised in that this in the interior is not delimited with respect to the surrounding atmosphere via physical means or via a barrier, such as a container envelope. In contrast, the edge region of the cloud is in direct contact with the atmosphere of the surroundings.

The complete volume of the explosive mixture is brought to ignition in the receiving space and in particular in the feed pressure conduit in a controlled manner via an ignition device.

If the total volume of the explosive mixture includes a cloud, then this too via the ignition device is brought to explode in a controlled manner together with the volume in the receiving space.

The ignition-effective component of the ignition device in particular is arranged in the cleaning apparatus. The ignition-effective component of the ignition device, for example, is arranged in the feed pressure conduit or is at least actively connected to this.

The total volume of the explosive mixture, as the case may be including the cloud, is produced for example in a time period of 2 seconds or less. The total volume is preferably produced in a time period of 1 second or less, preferably 0.5 seconds or less, in particular 0.2 seconds or less or even 0.1 seconds or less. The complete volume, however, can also be produced in a time period of 0.03 seconds or less. A time period of 0.01 to 0.2 seconds has been found to be possibly optimal.

The mentioned time period in particular includes the introduction of the explosive mixture into the receiving space.

The mentioned time period in particular is calculated from the opening of the metering fitting(s), which are described further below and are for introducing the at least one gaseous component into the feed pressure conduit of the cleaning apparatus, until closure of the metering fitting(s) for the purpose of completing the introduction.

The ignition and as a result the explosion of the explosive mixture with regard to control technology in particular is coordinated with the point in time of the closure of the metering fitting(s).

The ignition in particular is effected directly subsequent to the closure of the metering fittings. In particular, the ignition at the most has a very short delay.

The time interval between the opening of the metering fitting(s) for the purpose of introducing the at least one gaseous component and the ignition of the explosive mixture therefore in particular likewise lies in the time period described above.

Finally, the lower limit of this time period is technically determined in particular by the arrangement and switching ability of the metering fitting(s) for introducing the at least one gaseous component into the cleaning apparatus.

The at least one gaseous component is introduced into the cleaning apparatus via the at least one metering fitting, in particular with such a high speed, that the explosive mixture in the feed pressure conduit forms a pressure front, also called shock front, for forming the total volume of explosive mixture.

The pressure front considered in the outflow direction forms the boundary between the explosive mixture behind the pressure front and the atmosphere of the surroundings in front of the pressure front.

The explosive mixture in particular has an overpressure behind the pressure front in the flow direction.

The overpressure corresponds to the pressure difference between the actual pressure and the (atmospheric) pressure of the surroundings. This overpressure can be 0.5 bar or more, or 1 bar or more and in particular 2 bar or more. The overpressure can also be 2.5 bar or more or even 3 bar or more.

The ignition of the explosive mixture in particular is effected into the above mentioned overpressure conditions.

The explosive mixture is also characterised by a high density in relation to the conditions of the surroundings, since it has an overpressure behind of the pressure front. This is due to the fact that the compacted gas, which is introduced from the pressure container, is not yet completely relaxed in the cleaning apparatus at the point in time of the ignition, but rather is still under overpressure and is therefore compacted.

This means that under the conditions according to the invention, a greater mass of explosive mixture is led into the cleaning apparatus per volume unit than with conventional, open cleaning systems, with which the introduction of the gas is effected comparatively slowly and the gas has relaxed to the pressure of the surroundings on formation of the explosive mixture, but at the latest at the point in time of the ignition.

The introduction of the gaseous components under overpressure and accordingly at a high density permits the provision of a large mass of explosive mixture within a very short time. This means that the method according to the invention permits the induction of a large mass flow into the cleaning apparatus and its ignition within a very short time.

The power of the explosion in the case of a greater density of the explosive mixture given the same volume is accordingly greater since the explosive power is dependent on the mass of the explosive mixture which is made available.

The pressure front in particular pushes the surrounding air in front of it in the flow direction. The pressure front in particular expels the surrounding air out of the cleaning apparatus via the outlet opening. In particular, an intermixing of the explosive mixture and the air of the surroundings in the feed pressure channel or in the outlet device does not occur or remains minimal.

The explosive mixture and with this, the pressure front, can move to outlet opening or flow to this with a speed of 100 m/s or more, in particular 200 m/s or more.

An explosion pressure wave moving in the direction of the outlet opening is produced with the ignition of the explosive mixture in the feed pressure conduit. The propagation of the explosion pressure wave is effected at a very high speed. This in particular exceeds the speed of sound and can lie in the region of 3000 m/s.

The pressure of the explosion in each case is a multiple of the pressure of the explosive mixture before the explosion. The pressure of the explosion for example can be 25-fold the initial pressure. If the explosive mixture now has an overpressure, the pressure of the explosion is also increased by the corresponding multiple.

If the explosive mixture, for example, has a pressure of 1 bar (atmospheric pressure), then the pressure of the explosion corresponds to about 25 bar, with an increase of 25-fold. If the explosive mixture however has a pressure of 2 bar (in the overpressure region, greater density), then the explosion pressure is already about 50 bar, with an increase by 25-fold. Accordingly, the pressure of the explosion and, thus, the cleaning effect is very much greater if the explosive mixture brought to ignition has an overpressure in the cleaning apparatus.

According to one aspect of the invention, the explosive mixture is ignited when the pressure front is still located in the feed pressure conduit. According to one aspect of the invention, the explosive mixture is ignited when the pressure front is still in the outlet device.

According to one aspect of the invention, the cloud of explosive mixture is not yet formed or not yet completely formed at the point in time of the ignition. Thus, the cloud, for example, can be formed or fully formed not until on ignition of the explosive mixture. Thus, the explosive mixture can be expelled out of the outlet opening by way of the explosion pressure wave propagating in the feed pressure conduit in the direction of the outlet opening, amid the formation of the explosive cloud, and be directly be made to explode.

An explosion cycle can be divided into different strokes similarly to a combustion engine. In a first stroke, the metering fitting(s) to the feed pressure conduit are opened and the at least one gaseous component, e.g. from at least one pressure container (pressure tank) is introduced at pressure into the cleaning apparatus and led as an explosive, gaseous mixture via the feed pressure conduit to the outlet device. The cloud is formed via the outlet device outside the outlet opening as the case may be.

The at least one metering fitting is closed after introducing the defined quantity of gaseous component. The ignition is activated subsequently to this, and the formed total volume of explosive mixture is made to explode. A gaseous, explosive mixture can be produced afresh in the receiving space subsequently to the explosion, by way of renewed opening of the at least one metering fitting.

Pulsed explosions can also be produced with the method according to the invention if the complete volume of explosive mixture is produced in a very short time. This means that, for example, suitable total volumes of explosive mixture are produced and made to explode in each case successively in short time intervals.

For example, one or more explosions can be produced in one second. It is thus possible to produced 2 to 10 explosions within one second. Moreover, pulsed explosions can produce oscillations in the installation or receptacle, which assist the cleaning process.

The method for producing pulsed explosions also has the advantage that several total volumes of explosive mixture, each comprising a cloud, can be produced successively in a short time. The volumes of these clouds can be dimensioned lower in comparison to the production of individual clouds in a greater temporal interval. The clouds of pulsed explosions can, for example, have a volume of 1 to 5 liters. Larger clouds are also possible.

The losses due to intermixing in the edge zones, in particular with high flow in the atmosphere of the surroundings, are smaller with smaller clouds, so that a comparatively high explosive force is achieved despite a smaller size of the cloud. The risk of self-ignition at high temperatures is also significantly reduced with the very short formation time of smaller clouds. The production of smaller clouds moreover has the advantage that the cleaning apparatus can be designed smaller.

The formation of the explosive mixture in the feed pressure conduit accompanies the formation of the cloud from the explosive mixture on exit of the outlet opening of the cleaning apparatus at the end of the feed pressure conduit.

The shorter this period of time, the less is the degree of intermixing of the cloud with the atmosphere of the surroundings in the interior of the receptacle or the installation, on ignition of the mixture.

Moreover, it has been surprising found that a comparatively large density difference counteracting an intermixing exits between the surrounding atmosphere which, for example, is formed of hot flue gases (200° to 1000° C.), and the explosive mixture.

The degree of intermixing of the explosive mixture exiting from the outlet opening with the atmosphere of the surroundings however not only depends on the time duration, over which the formation of the cloud and the subsequent ignitions extends. Rather, the geometry of the outlet device which connects to the at least of feed pressure conduit and which forms at least one outlet opening is also a decisive factor.

Specifically, it has been found that an abruptly ending feed pressure conduit leads to a swirling of the exiting explosive mixture, and as a result to its dilution. Thus, the atmosphere of the surroundings, e.g. flue gases are sucked in, particularly in the region of the outlet opening, at which the explosive mixture leaves the feed pressure conduit at high speed. This leads to a dilution of the mixture below the explosion limit. The dilution is down to mixing procedures with the atmosphere of the surroundings in the interior or the receptacle or insulation due to eddy formation.

A dilution of the explosive mixture however entails a loss of explosive performance. In the best case, a mixture diluted in such a manner only burns up, or nothing at all happens in the receptacle or installation despite the large heat.

The greater the exit speed of the explosive mixture out of the feed pressure conduit, the greater is the swirling effect. It is precisely when producing a cloud from an explosive mixture in the interior of the receptacle or installation that it is important for this cloud to be produced and ignited as quickly as possible. Specifically, the quicker such a cloud can be produced and ignited, the better can this be preserved until ignition, i.e. the lower is the dilution of the cloud due to intermixing processes. The explosive performance of the mixture is retained by way of this.

The as rapid as possible production of such a cloud however indeed necessitates high exit speeds of the explosive mixture out of the feed pressure conduit. However, it is precisely this measure that leads to a high intermixing of the forming cloud with the surrounding atmosphere on account of swirling flows on exit from the feed pressure conduit, as has been mentioned.

This problem is also a reason why the mixture until now has always been introduced into the interior of the receptacle or installation in a manner protected in a container envelope.

The cleaning apparatus according to the invention comprises a feed pressure conduit and an outlet device which is arranged on the end of the pressure feed conduit and which is with at least one outlet opening.

The feed pressure conduit and the outlet device form a receiving space for receiving at least a part of the introduced explosive mixture. The receiving space is open to the outside via the at least one exit opening.

The cleaning apparatus and in particular its outlet device is designed for introducing the explosive mixture into the interior of the receptacle or the installation and for forming a cloud from the explosive mixture in the interior of the receptacle or the installation.

The cross-sectional area of the at least one outlet opening is preferably greater than the cross-sectional area of the feed pressure channel of the at least one feed pressure conduit.

The outlet device can also comprise several outlet openings. Moreover, several feed pressure conduits can be led to the outlet device. The outlet device in particular comprises one or a plurality of outlet bodies which form the outlet opening or the outlet openings.

The outlet body is a component that forms a flow channel for the explosive mixture running out in the outlet opening. The outlet opening indicates the transition from the cleaning apparatus to the interior of the receptacle or installation, in which transition the exiting explosive mixture is no longer led through the cleaning apparatus.

The outlet body or its flow channel is part of the receiving space for the explosive mixture.

The outlet bodies can be fed with the explosive mixture by way of a common feed pressure conduit or separate feed pressure conduits. Accordingly, the outlet device can be connected to one or more feed pressure conduits. The outlet device can also comprise conduit branches which lead the explosive mixture to the individual outlet bodies.

Moreover, a feed pressure conduit can also be led into a manifold or distribution space, from which the explosive mixture is fed to the individual outlet bodies via openings (passages). The distribution space, for example, can be spherical or hemispherical. One or more flow guidance elements can be arranged in the distribution space. Such a flow guidance element can be designed, for example, as an impact bead.

In these cases, the total cross-sectional area of the outlet openings is preferably larger than the cross-sectional area of the feed pressure channel or larger than the total cross-sectional area of the feed pressure channels.

The total cross-sectional area of the openings in the distribution space can range from slightly larger to slightly smaller than the cross-sectional area of the feed pressure channel or than the total cross-sectional area of the feed pressure channels.

The outlet device or its outlet body including the outlet opening is preferably designed as a diffuser. The diffuser at the same time forms part of the receiving space for an explosive mixture.

If the outlet device comprises several outlet bodies, then these can also have a cylindrical shape or another geometric shape.

The outlet device or its outlet body can be designed as an end section of the feed pressure conduit.

A diffuser is a component that slows down gas flows. It is characterised by a cross-sectional enlargement which, departing from the feed pressure conduit, increases towards the outlet opening. This cross-sectional increase is preferably continuous. The diffuser in principle represents the opposite of a nozzle.

Specifically, it has been surprisingly found that the design of the end section of the feed pressure conduit as a diffuser or of the outlet body of the outlet device as a diffuser permits the formation of an explosive cloud from the explosive mixture, in the interior of the receptacle or installation, without this cloud having to be protected by a container envelope. The diffuser effects a change of the introduction speed from a high value in the feed pressure conduit to a reduced value in the region of the at least one outlet opening. The eddy formation and thus the intermixing of the mixture with the atmosphere of the surroundings directly subsequent to the outlet opening is prevented or at least considerably reduced due to the slowing of the explosive mixture towards the outlet opening.

Since the flow is slowed down, in particular directly before the outlet opening, the explosive mixture despite this is led to the outlet device via the feed pressure conduit at a comparatively high speed and under a high pressure. This, for example, permits a rapid formation of the cloud in the interior. The same effect also permits a rapid filling of the receiving space with explosive mixture.

Moreover, the gaseous components of the explosive mixture that enter the diffuser from the feed pressure channel expand due to the cross-sectional increase. A cooling of the explosive mixture is achieved by way of this. This cooling effect is advantageous with the formation of the cloud, since the temperature of the forming cloud forming in the interior lies significantly below the self-ignition temperature. The danger of self-ignition or of an ignition of the cloud due to the hot atmosphere of the surroundings in the interior of the receptacle or of the installation is reduced or ruled out by way of this.

Specifically, it has been surprisingly found that a cloud of an explosive mixture that is produced with the method according to the invention is not ignited in the interior of an incineration installation, even of the temperature of the surroundings lies far above the self-ignition temperature. This, as already mentioned, is due to the fact that on the one hand the cloud is formed and made to explode in a very short time, compared to the filling of a container envelope, so that this cloud in the interior cannot heat up beyond the self-ignition temperature, and on the other hand due to the fact that the cloud is not intermixed with the atmosphere of the surroundings.

The cloud is already ignited in a controlled manner via the cleaning apparatus, before this cloud is heated to the self-ignition temperature by the hot surroundings.

The diffuser in particular includes a funnel-like widening or consists of such. The diffuser in particular consists of metal. It can be manufactured from metal sheet/plate, such as steel sheet/plate.

The funnel-like diffuser can, for example, be designed such that it can be folded together towards its longitudinal axis for example. The outlet device of the cleaning apparatus can be led through a narrow opening into the interior and unfolded there, in this manner. The funnel-like diffuser is folded together again towards its longitudinal axis for withdrawing the outlet device out of the interior again.

The flow cross section in particular departing from the feed pressure channel can be increased in a continuous manner towards the outlet opening thanks to the diffuser.

The pressure feed conduit towards the outlet opening, for example, merges into a funnel-like widening. This transition is preferably continuous.

The feed pressure channel can have a constant cross section. The cross section of the feed pressure channel can also increase towards the outlet device. The cross-sectional increase can be continuous.

In particular, one can envisage the cross section increasing in a defined section in the mixing zone, in particular in the region of and/or subsequent to the inner pipe end. The cross-sectional increase can be divergent.

The opening (cone) angle of the diffuser is preferably 45° (angle degrees) or smaller, preferably 30° or smaller and in particular 20° or smaller. The mentioned opening angle in particular can also be 15° or smaller or even 10° or smaller. The opening angle corresponds to the angle between the longitudinal axis of the feed pressure conduit and the opening axis of the funnel-like widening. The opening axis connects the point of the funnel-like widening that is outermost in the direction of the longitudinal axis, at the height of the outlet opening to that point on the feed pressure channel, at which the feed pressure channel opens into the funnel-like widening.

According to a preferred development of the invention, the ratio of the length of the diffuser to the largest diameter of the outlet opening is 2:1 or more and preferably 3:1 and in particular at least 5:1 or more. The length of the diffuser is measured along the longitudinal axis.

According to a preferred further development of the invention, the ratio of the largest diameter of the outlet opening to the inner diameter of the feed pressure conduit is 3:1 or more, and in particular 5:1 or more.

According to a special further development of the invention, the funnel-like widening at least proximally corresponds to an exponential funnel. The cross-sectional area of an exponential funnel is preferably described by the exponential function:

$$A(x)=A_h \cdot e^{kx} \quad \text{i.}$$

$A_h$ is thereby the area cross section of the funnel neck, k the funnel constant, which is to say the opening degree of the funnel, and A(x) its area cross section at a distance x to the funnel neck.

According to a particular further development of the invention, a swirl element is arranged in the diffuser. The swirl element serves for the additional reduction of the flow speed in the diffuser before the exit of the mixture.

The outlet device can be designed in order to form several or one common cloud from the explosive mixture.

The outlet openings of a plurality of outlet bodies can be aligned in different spatial directions.

Various arrangement variants for the outlet body are possible for forming the at least one cloud. Thus, the outlet bodies with their outlet openings for example can be aligned radially outwards from a centre or a centre axis. The outlet bodies in particular can be aligned or directed running radially outwards from a centre in different spatial directions. The different spatial directions can lie in two dimensions, i.e. in a plane, or in three dimensions.

Thus the outlet bodies can:

be directed radially outwards from a centre, wherein the outlet openings define a spherical or hemispherical outlet surface;

be arranged in a plane, i.e. e.g. in a disc-like manner, directed radially outwards from a centre, wherein the outlet openings define an annular outlet surface; or be directed radially outward from a centre axis, wherein the outlet openings define a cylinder-shaped outlet surface.

The outlet openings thereby are always directed radially outwards.

All the described outlet devices can be arranged on a cleaning-side end of a cleaning lance, as is described in the general description part and in particular in FIGS. 1 and 2.

Thus, for example, the explosive mixture which is led to the outlet device can be led via several such outlet bodies into the interior of the receptacle or of the installation, whilst forming a common or several adjacent clouds.

According to a particular embodiment of the outlet device, this is designed such that the gas flow undergoes a deflection by 90° to the side out of the longitudinal direction. The at least one outlet opening is thereby directed to the side. The outlet device in particular is T-shaped, with two outlet openings, which are directed to the side. According to this embodiment, the gas flow divides in the outlet device and is deflected by 90° to the side in each case.

At least one gaseous component is led from at least one pressure container via at least one metering fitting into the cleaning apparatus at overpressure, for producing the explosive total volume. Pressure sensors for measuring the pressure in the pressure container or containers can be provided on the pressure container or containers.

Thus, in each case a first and a second gaseous component can be led separately into the cleaning apparatus in each case from at least one pressure container via in each case at least one metering fitting. Several gaseous components in particular are led into the cleaning apparatus in a stoichiometric ratio to one another.

The at least one metering fitting serves for the metered or dosed introduction of the at least one gaseous component into the cleaning apparatus. The metering fittings in particular are valves. The valves can be magnet valves.

The at least one gaseous component can be introduced into the feed pressure conduit in a direct or indirect manner via at least one introduction channel on the cleaning apparatus.

The pressure containers, for example, can have a maximal pressure of several bar, such as 10 bar or more, and in particular of 20 bar or more, at the beginning of the introduction. A pressure of 20 to 40 bar can thus be provided. This permits the introduction of the gaseous components into the cleaning apparatus at a high pressure and accordingly a high speed.

Thus the at least one gaseous component can be introduced with an average speed of more than 50 m/s (meters per second), in particular of above 100 m/s, advantageously above 200 m/s. The average speed can e.g. be 200 to 340 m/s. The speed of sound is preferably not exceeded.

One can envisage the pressure containers in each case not being completely emptied, i.e. to the ambient pressure. Thus the residual pressure in particular has an overpressure. The residual pressure can be 5 bar or more, in particular 10 bar or more, such as e.g. 10 to 15 bar. High speeds are achieved on introduction due to the high residual pressure.

The introduction of the at least one gaseous component can be effected according to the principle of the differential pressure. The differential pressure method is characterised in that the residual pressure in the pressure container lies in the overpressure region after completion of the introduction of the gaseous components.

With regard to the overpressure, it is the case of that pressure value that results from the difference between the pressure prevailing in the pressure container and the prevailing ambient pressure. The ambient pressure in particular is the pressure prevailing outside the pressure container. The ambient pressure for example is the atmospheric pressure. This means, for example, that the pressure container or the pressure containers are not emptied down the ambient pressure.

The control of the quantity of gaseous components, which is to be introduced, can be effected via the detection of the pressure in the pressure container, wherein these components, for example, should be in a stoichiometric ratio in the case or two or more gaseous components. Thus, the corresponding nominal residual pressure or differential pressure can be determined from the quantity of gaseous component to be introduced, assuming a known maximal pressure at the beginning of the introduction procedure. The metering fitting(s) are opened via the control device for so long, until the nominal residual pressure is measured by the pressure sensor. The pressure sensor is accordingly connected to the control device.

The control of the quantity to be introduced, which, for example, in the case of two or more gaseous components should be in a stoichiometric ratio, in particular can be effected also via the opening time of the metering fittings, thus in a time-controlled manner.

Thus, the gas speed through the metering fitting can be numerically or empirically determined assuming a known maximal pressure at the beginning of the introduction procedure. A direct relation between the opening time and the introduced gaseous component can be derived from this. The predefined opening time of the metering fittings is controlled via the control device.

A feed conduit, for example in the form of a hose, can connect to the metering fitting, at the feed side of the at least one metering fitting. The feed conduit can be for the feed of the gaseous components out of the pressure container.

The feed conduit can be part of the pressure container for the gaseous component or even form this pressure container. The gaseous component in this case is under pressure in the feed conduit. The pressure can assume the values specified above.

The feed conduit for the oxygen as well as for the combustible gas can be designed as part of the pressure container or as pressure containers for the gas, according to the type described above.

One, several or all gaseous components in each case can be introduced into the cleaning apparatus via one or more metering fittings. If a gaseous component is introduced into the cleaning apparatus via several metering fittings, then these metering fittings can be connected to a common or to different pressure containers.

The number of metering fittings per gaseous component can also be determined according to the stoichiometric ratio, with which the gaseous components are introduced into the cleaning apparatus.

Moreover, the flow cross sections of the metering fittings can be in a stoichiometric ratio to one another.

The flow cross sections of the introduction channels can also be in a stoichiometric ratio to one another.

Non-return (check) elements such as non-return valves can be arranged downstream of the metering fittings in the flow direction. These protect the metering fittings from a blowback as can occur for example with the ignition of the explosive mixture. The non-return elements moreover also prevent the exchange of gaseous components between the pressure containers. The non-return elements in particular are arranged in front of the feed pressure conduit in the flow direction.

A device for feeding an inert gas, such as nitrogen can be arranged at the same location instead of non-return elements. The introduced inert gas forms a type of buffer and prevents the heating of the metering fitting due to the hot gases of the explosion. On the other hand, the introduced inert gas forms a gas barrier and prevents the exchange of gaseous components between the metering fittings.

The cleaning device moreover preferably includes an ignition device. The explosive mixture is preferably ignited in the feed pressure conduit or in the outlet device by way of the ignition device. Hereby, the initiated explosion is transmitted from the cleaning apparatus to the cloud of the explosive mixture outside the diffuser and onto the explosive mixture in the receiving space of the outlet device.

The ignition of the explosive mixture is effected with means which are known from the state of the art. This is preferably effected by way of electrically triggered spark ignition, by way of auxiliary flames or by way of pyrotechnic ignition with the help of suitably attached ignition means and ignition device.

The ignition device in particular is an electrical ignition device. This is characterised in that this forms an ignition spark or in particular an electric arc for ignition.

The cleaning device in particular comprises a control device. The control device amongst other things serves for the control of the ignition device. The control device moreover in particular serves for the control of the metering fittings for introducing gaseous components into the cleaning apparatus. The control device therefore serves for the production of the explosive mixture, in particular for forming the cloud. The control of the metering fittings as well as of the ignition device, in particular are coordinated with one another with regard to control technology.

The control device in particular is designed to open and close the metering fittings within the mentioned time periods.

The cleaning apparatus for carrying out the method according to the invention in particular can be a longitudinal component, such as a cleaning lance. Such a cleaning lance is described for example in EP 1 362 213 B1. Many of the features and embodiment variants which are described therein can therefore be conferred upon the present patent application with regard to the construction of the feed conduit and cooling conduit or the supply device.

The longitudinal component is, for example, designed as a tube-like device.

The cleaning apparatus, in particular the longitudinal component, in particular includes a feed-side and a cleaning-side end section, wherein the outlet opening is arranged on the cleaning-side end section. The outlet device in particular is also arranged on the cleaning-side end section.

With regard to the feed-side end section, it is the case of that end section, at which the at least one gaseous component is introduced into the cleaning apparatus. As the case may be, the expression user-side end section is also valid since this end section as a rule faces or is towards the user. The feed-side end section can form a grip part, via which the cleaning apparatus can be held by the user.

With regard to the cleaning-side end section, it is the case of that end section that is directed towards the location to be cleaned.

The feed-side end section, for example, includes a metering device, in which the explosive mixture is made available. The mentioned metering fittings for introducing the gaseous components or mixture are arranged on the metering device.

The cleaning-side end section includes the outlet opening, and in particular the outlet device. The feed pressure conduit is arranged between the metering device and the outlet opening or outlet device. This can be designed as a feed pressure conduit.

The longitudinal component or the cleaning lance can have a length of one to several meters, e.g. 4 to 10 m.

The cleaning lance moreover includes at least one feed pressure conduit for receiving the explosive mixture. The at least one feed pressure conduit is preferably integrated into the structure of the longitudinal component. The longitudinal component can be designed in a tube-like manner for this. The one or more feed pressure conduits can also be designed as separate conduits outside or within the longitudinal component and be led along this.

The metering fittings for the feed of the oxygen and the combustible gas, for example, are arranged on the longitudinal component, in particular on the feed-side end section of the longitudinal component.

The metering fittings in particular are arranged in a manner such that these introduce the gaseous components indirectly or directly into the feed pressure conduit or feed pressure conduits of the longitudinal component. The gaseous components are mixed with one another in the longitudinal component, for example, in a mixing zone.

If several metering fittings are provided for the explosive mixture or in each case for the gaseous component, then these can be arranged successively, for example, in the longitudinal direction of the longitudinal component. Several metering fittings in each case for gaseous component can be arranged along the periphery of the associated introduction channel, considered transverse to the longitudinal direction.

The longitudinal component includes a gas lead pipe, also called outer pipe. The gas lead pipe, for example, forms the feed pressure conduit with the feed pressure channel. An inner pipe can be arranged in the gas lead pipe in the feed-side end section. The inner pipe forms a first introduction channel for a first gaseous component. A second, annular introduction channel for a second gaseous component is formed between the gas lead pipe and the inner pipe. The two pipes and accordingly the introduction channels can be arranged concentrically to one another.

The inner pipe terminates within the gas lead pipe, so that the gas lead pipe merges into a feed pressure conduit at the end of the inner pipe.

The first gaseous component, in particular a combustible gas, is introduced into the first introduction channel via at least one first metering fitting. A second gaseous component, in particular an oxygen-containing gas is introduced into the second introduction channel via at least one second metering fitting. A mixing zone, in which the two gaseous components mix with one another is formed subsequently to the inner pipe end, with the exit of the first gaseous component out of the inner pipe into the connecting pressure feed channel.

The gaseous components as a result of this are led as an explosive mixture through the feed pressure channel of the feed pressure conduit, which connects onto both introduction channels, to the cleaning-side end section. The feed pressure channel or the feed pressure conduit is formed by an outer pipe (tube).

A supply device is provided on the feed side of the metering fittings. The supply device supplies the cleaning apparatus with the respective gaseous components. The supply device, for example, includes one or more pressure containers, in which the gaseous components or the explosive fixture is stored under pressure.

The metering fittings can thus be connected to feed conduits, for example, in the form of hoses. The feed conduits can be connected on pressure containers. The metering fittings can also be connected directly to respective pressure containers.

According to a particular embodiment, a narrowing of the cross section is provided in the region of the inner pipe end. This narrowing can be of a nature such that the cross section of the first, annular introduction channel narrows towards the inner pipe end, for example, narrows in a conical manner. In particular the cross section can be convergent.

The narrowing can moreover be such that the cross section of the connecting feed pressure channel increases in the feed direction, conically, subsequent to the inner pipe end. The cross section can be divergent.

The inner pipe end can lie in the region of the cross section increasing in the feed direction. The narrowest location considered in the feed direction can lie behind the inner pipe end.

The geometric design of the cross-sectional change in particular can be of such a nature that the cleaning apparatus forms a Laval nozzle in the region of the inner pipe end, with a suitable introduction of the gaseous components into the introduction channels.

The flow direction of the gaseous components into the introduction channels subsequent to their introduction into the introduction channel in particular is the longitudinal direction of the longitudinal component. The flow direction of the gaseous mixture in the feed pressure conduit in particular is in the longitudinal direction of the longitudinal component.

The ignition device for igniting and this for triggering the explosion, for example, is also provided on the longitudinal component.

The cleaning device and in particular the associated cleaning apparatus can also be designed as a fixed installation on the receptacle or on the installation, in particular on a wall, since no consumed material such as container envelopes is necessary for the operation of the present cleaning device. The outlet device of such a fixed installation is thereby preferably arranged in the interior of the receptacle or installation. However, one can also envisage the at least one outlet opening of the outlet device being arranged in the wall of the receptacle or the installation, or being integrated into this.

A cleaning device according to the invention which is designed as a fixed installation has the advantage that this can be operated by the operating company of an installation itself and no service team needs to be called up for cleaning. Significant costs can be saved by way of this. Moreover, a more frequent cleaning can be carried out, by which means the degree of contamination and thus the effort for an individual cleaning process can be kept within reasonable limits.

BRIEF DESCRIPTION OF THE DRAWINGS

The subject-matter of the invention is hereinafter explained in more detail by way of preferred embodiment examples, which are represented in the accompanying drawings. In each case in a schematic manner are shown in:

FIG. 4: a further embodiment example of an outlet device;

FIG. 8*a*: a further embodiment example of an outlet device;

FIG. 8*b*: a further embodiment example of an outlet device;

FIG. 9*a*: a further embodiment example of an outlet device;

FIG. 9*b*: a further embodiment example of an outlet device;

FIG. 18: a particular embodiment of the mixing zone of a cleaning apparatus;

FIG. 19*a*: a further embodiment of a cleaning device;

FIG. 19*b*: a cross-sectional view along the section line A-A according to FIG. 19*a*.

DETAILED DESCRIPTION OF THE INVENTION

Figure 1:
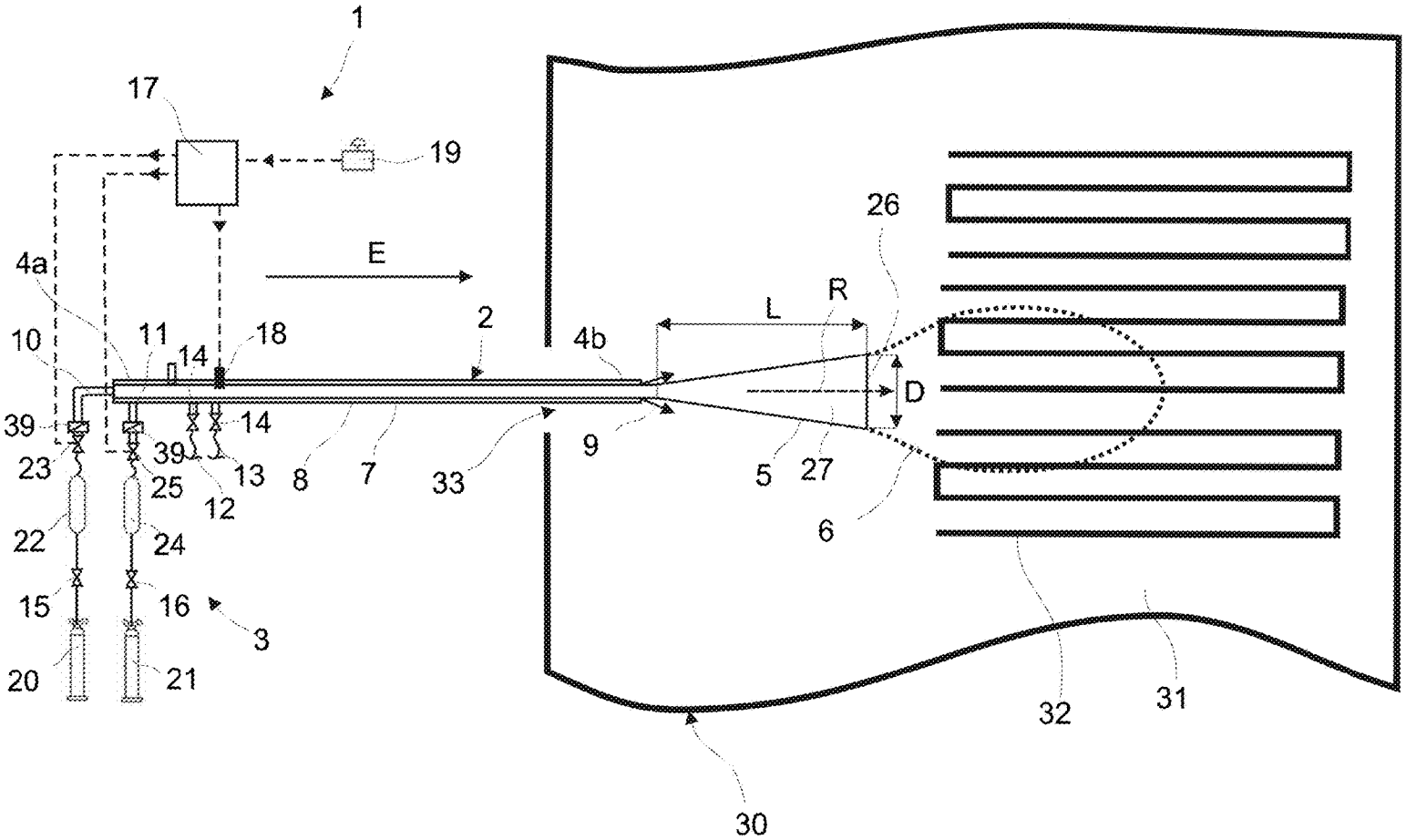
FIG. 1: a first embodiment example of a cleaning device according to the invention, with an outlet device.

Basically, the same parts are provided with the same reference numerals in the figures.

Certain features are not represented in the figures, for an improved understanding of the invention. The described embodiment examples are exemplary with regard to the subject-matter of the invention and have no limiting effect.

A first embodiment example of a cleaning device 1 according to the invention and for carrying out the cleaning method according to the invention is represented in FIG. 1. The cleaning device 1 comprises a coolable cleaning lance 2. The cleaning lance 2 comprises an outer encasing pipe 8, and an inner gas lead pipe 7, which is arranged within the outer encasing pipe 8 and which, amongst other things, forms the feed pressure conduit. The outer encasing pipe 8 encases the inner gas lead pipe 7 and by way of thus forms an annular cooling channel. The inner gas lead pipe 7 amongst other things forms a closed feed pressure channel.

The cleaning lance 2 at its feed-side end section 4*a* comprises a metering device with connections for the feed of gaseous components for forming an explosive gas mixture.

An outlet device in the form of a diffuser 5 shaped in a funnel-like manner connects to the inner gas lead pipe 7, at the cleaning-side end section 4*b*.

The cleaning lance 2 is supplied with the gaseous components for creating the explosive mixture via a filling device 3. The cleaning lance 2 is moreover controlled via a control device 17. The control device 17 in particular serves for the control of the feed of the gaseous components into the feed pressure conduit as well as of the ignition of the explosive mixture.

The cooling can be a permanent cooling or one which is manually controlled. A control of the cooling via the control device 17 however is also possible.

The feed of the gaseous components for the production of the explosive mixture is effected via two gas feed conduits 10, 11, which are directly or indirectly connected to the inner gas lead pipe 7.

A first gas feed conduit 10 is connected to a pressure container 22 via a first valve 23, wherein this pressure container, in turn, is connected via a second valve 15 to a commercially available first gas bottle 20, for example, an oxygen bottle. A non-return valve 39 is arranged between the first valve 23 and the run-out of the gas feed conduit 10 into the inner gas lead pipe 7.

A second gas feed conduit 11 is likewise connected via a first valve 25 to a second pressure container 24. This, in turn, is connected via a second valve 16 to a commercially available second gas bottle 21. The second gas bottle 21 accordingly contains a combustible gas, for example acetylene, ethylene or ethane. A non-return valve 39 is likewise arranged between the first valve 25 and the run-out of the gas feed conduits 11 into the inner gas lead pipe 7.

The pressure containers 22, 24 can also be fed with the respective gaseous components for creating the explosive mixture in another manner, instead of by way of gas bottles 20, 21.

The pressure containers 22, 24 are filled with the respective gases after opening the second valves 15, 16. The pressure container volumes, for example, can be values in a stoichiometric ratio of 3.7 liters for ethane and 12.5 liters for oxygen, or a multiple thereof. A filling pressure of 20 bar is applied, for example, for creating a cloud 6 with a volume of about 110 liters, and a filling pressure of 40 bar is applied for creating a cloud 6 with a volume of about 220 liters. Of course, a uniform, higher filling pressure can also be applied instead of different filling pressures, wherein the pressure containers only provide the required gas quantity for filling a smaller container and therefore are not completely emptied. In other words, the provision of the gaseous components in a stoichiometric ratio here is effected according to the principle of differential pressure.

Moreover, means via which the pressure in the pressure containers 22, 24 can be set independently of the pressure in the gas bottles 20, 21 or of the gas fed to the pressure containers 22, 24 in another manner can also be provided. Greater pressures that prevail in the gas bottles 20, 21 can be produced in the pressure container 22, 24 on account of this.

These means can, for example, comprise a compressor. The pressure in the pressure container can furthermore also be produced pneumatically via a further gas, such as nitrogen, or be produced hydraulically, wherein the gaseous component is brought to the desired pressure via a moved piston in the pressure container.

Accordingly, greater outlet pressures can be produced independently of the prevailing pressure in the gas bottles 20, 21. This in turn permits a more rapid feed of the gaseous components into the inner gas lead pipe 7 and, thus, a quicker formation of the cloud 6 from the explosive mixture.

The pressure containers 22, 24 serve for dosing or metering the gaseous components. The metering is thereby effected in each case before the introduction of the gaseous components into the inner gas feed pipe 7.

The explosive mixture is ignited by way of an ignition device 18, on or after the production of the cloud 6 from the explosive mixture. The ignition device 18 is attached on the cleaning lance 2 and effects the ignition of the explosive mixture in the feed pressure channel. The initiation of a cleaning cycle with the steps comprising the production of an explosive mixture and ignition of the mixture can be activated or triggered via the control device 17 by way of a switch 19.

The annular channel, which is formed by the outer encasing pipe 8 around the inner gas lead pipe 7, serves as a cooling channel, as has already been mentioned. A viscous coolant, which is to cool the inner gas lead pipe 7, circulates through this channel.

The cleaning lance 2 at its feed-side end section 4*a* or in it proximity accordingly comprises connections in each case for the feed conduits 12, 13 of the coolant feed. Water, for example, is fed through a first feed conduit 12, and air for example through a second feed conduit 13. Also only one coolant feed conduit can be provided for the feed of only one coolant, e.g. water. The coolant, e.g. water/air mixture, is led between the outer encasing pipe 8 and the inner gas lead pipe 7. The coolant serves for the protection of the cleaning lance 2 from overheating. The coolant exits again at the cleaning-side end section 4*b*, which is indicated by arrows 9.

The coolant, which is led through the cleaning lance 2 and exits at the cleaning side also cools the diffuser 5. However, it is not an essential feature of this embodiment example that the coolant exits at the cleaning side and cools the diffuser.

The coolant feed into the coolant channel of the cleaning lance is controlled via suitable valves 14. The actuation of these permits the cooing to be switched-on and off. The valves can be actuated by hand or be controlled via a control device. A permanent cooling is likewise possible.

A lance cooling designed in this manner is preferably activated before the introduction of the cleaning lances 2 into the hot interior of an incineration installation 30 to be cleaned. It typically remains switched on during the whole time during which the cleaning lances 2 are exposed to the heat. Such an active lance cooling can be effected via the control device 17, by way of the valves 14 of the cleaning lance 2 being actuated via the control device 17.

Of course, it is also possible to introduce a coolant through a cooling connection at the feed-side end of the lance, and to let it flow back again to the same end section. This would be possible, for example, in the case of an outer encasing pipe that is closed at one side.

The active cooling described above, however, is optional and is not a necessary feature of the present invention. The outer encasing tube 8 and the annular channel can, for example, also be designed merely for passive cooling and act in an insulating manner, and in this manner protect the cleaning lance 2 and the explosive gas mixture which is located therein or its gaseous components from overheating, For carrying out the cleaning method according to the invention, the cleaning-side end section 4*b* of the cleaning lance 2 is introduced through a through-opening 33 into the interior 31 of an incineration installation 30 in the introduction direction E and is placed, for example, in front of a bundle of pipes 32. First of all, the first valves 23, 25 thereafter or simultaneously are briefly opened, for example, for less than one second. During this time, the gas contents of the pressure containers 22, 24 flow via the gas feed conduits 10, 11 into the inner gas lead pipe 7 of the cleaning lances 2.

The gaseous components are mixed with one another into an explosive gas mixture in the inner gas lead pipe 7 and are led through the feed pressure conduit in the direction of the diffuser 5. The feed pressure conduit and the diffuser 5 form a receiving space 27 for at least one part of the introduced explosive mixture. Another part of the gaseous mixture, for example, flows outwards via the diffuser 5 and forms a cloud.

Basically, also only the receiving space 27 can be filled with the explosive mixture. In this case for example, no cloud is formed outside the diffuser 5.

The formation of the cloud 6 from the explosive mixture, for example, lasts 0.015 to 0.03 seconds.

The explosive mixture after the closure of the first valves 23, 25 is ignited immediately or after a selected time delay, by way of the ignition device, and the cloud 6 is made to explode.

Figure 2:
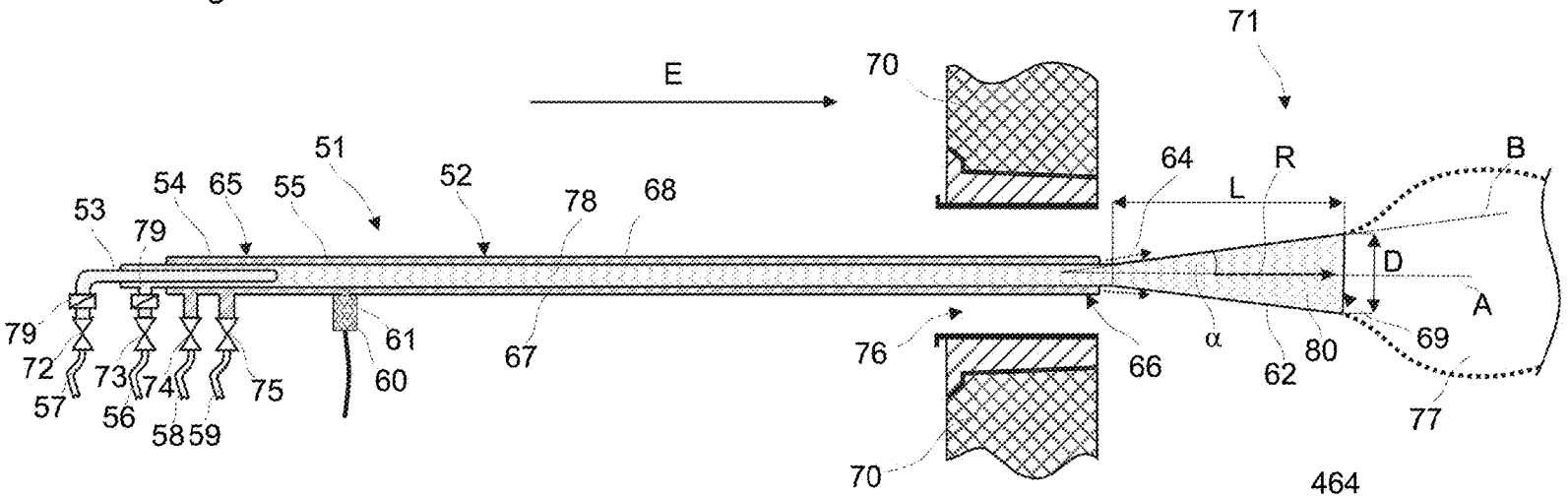
FIG. 2: a second embodiment example of a cleaning device according to the invention, with an outlet device.

The embodiment example of the cleaning devices 51 according to the invention and which is represented in FIG. 2 comprises a coolable cleaning lance 52 that is led in the introduction direction E through the through-opening 76 of an incineration installation 70 in its interior 71.

The cleaning lance 52 in each case comprises a gas lead pipe 67 that extends from a feed-side end section 65 to a cleaning-side end section 66 and through which the explosive mixture or its gaseous components is/are led in the direction of the outlet opening 69. The gas lead pipe 67 amongst other things forms a closed feed pressure channel 78 of a feed pressure conduit.

A metering device is provided at the feed-side end section 65. An inner pipe 53, also called inlet piece, which is arranged concentrically to the gas lead pipe 67 runs out into the gas lead pipe 54. The inner pipe 54 forms a first introduction channel and ends within the gas feed pipe 67. The gas lead pipe 67 at this location merges into a feed pressure conduit with a feed pressure channel.

A first gaseous component of the explosive mixture is introduced into the gas lead pipe 67 via the inner pipe 53. The inner pipe 53 is hereby connected to a first gas feed conduit 57 via a connection.

An annular, second introduction channel, into which a second gas feed conduit 56 for the feed of a second gaseous component of the explosive mixture into the gas lead pipe 67 runs out via a further connection, is formed between the inner pipe 53 and the gas lead pipe 67, which is also called outer pipe.

Valves 72, 73, via which the feed of the gaseous components into the gas lead pipe 67 can be controlled are arranged directly at the connection of the gas feed conduits 56, 57 onto the cleaning lance 52. A non-return valve 79 is arranged in each case between the valves 72, 73 and run-out of the gas feed conduits 56, 57 into the gas lead pipe 67.

The first gaseous component mixes with the second gaseous component into an explosive mixture, in a mixing zone directly at the inner pipe end in the gas feed pipe 67. The first gaseous component, for example, can be a gaseous or liquid fuel, in particular a hydrocarbon compound. The second gaseous component can be oxygen or an oxygen-containing gas.

An ignition device 60 with a spark plug 61 is moreover attached on the cleaning lance 52, and this spark plug runs out into the gas lead pipe 67 and is designed to electrically ignite the explosive mixture in the gas lead pipe 67.

The gas lead pipe 67 is encased by an encasing pipe 55. An annular cooling channel 68, in which a coolant for cooling the gas lead pipe 67 is introduced is formed between the encasing pipe 55 and the gas lead pipe 67. For this, a first and a second connection, to which a first and second coolant feed conduit 58, 59 are connected for the feed of a first and second coolant, are provided on the feed-side end section 65 of the cleaning lance 52. The first coolant can be cooling liquid such as water, and the second coolant can be a gas, such as, for example, air.

Valves 74, 75, via which the coolant feed into the coolant channel 68 can be controlled, are arranged at the connection of the coolant feed conduits 58, 59 to the cleaning lance 52. The valves 74, 75 can be actuated by hand or be controlled via a control device. A permanent cooling is likewise possible.

Also, only one coolant feed conduit can be provided for the feed or only one coolant, e.g. water. The coolant, e.g. a water/air mixture is thus led between the encasing pipe 55 and the gas lead pipe 67. The coolant serves for the protection of the cleaning lance 52 from heating too much.

The coolant 64 can exit out of the cooling channel 68 at the cleaning-side end section 66 via an axial exit opening. The coolant which is led through the cleaning lance 52 in this manner can also cool the subsequently described diffuser 62.

A lance cooling, which is designed in this manner, is preferably activated before the introduction of the cleaning lances 52 into a hot receptacle to be cleaned. It typically remains switched on during the whole time, in which the cleaning lance 52 is exposed to the heat.

The active cooling, which is described above, however is optional and is not a necessary feature of the present invention.

An outlet device in the form of a funnel-like diffuser 62, at whose end the outlet opening 69 for the explosive mixture is located, connects to the gas lead pipe 67, at the cleaning-side end section 66, which lies opposite the feed-side end section 65. The diffuser 62 forms an opening angle α. Moreover, the diffuser 62 forms a ratio of the diffuser length to the greatest diameter of the outlet opening 69 L:D. The length L of the diffuser 62 is measured along its longitudinal axis A (see also FIG. 1).

The explosive mixture, which flows through the gas lead pipe 67 at a high speed, is calmed in the diffuser 62 before exit into the inner space or interior 71, so that as little as possible swirling in the boundary region between the explosive mixture and the surrounding atmosphere occurs subsequent to the connection opening 60 when forming the cloud 77.

The feed speed in the feed pressure channel of about 300 m/s (speed of sound) can be reduced to 4 m/s at the outlet opening for example, thanks to the outlet device according to FIGS. 1 and 2, by which means a cloud formation is possible at all.

The feed pressure channel and the diffuser 62 also form a receiving space 80 for at least a part of the introduced explosive mixture. Another part of the gaseous mixture can be flow outwards via the diffuser 62 and form a cloud, as mentioned.

Basically, here too, only the receiving space 80 can be filled with the explosive mixture. In this case, for example, no cloud is formed outside the diffuser.

Figure 3:
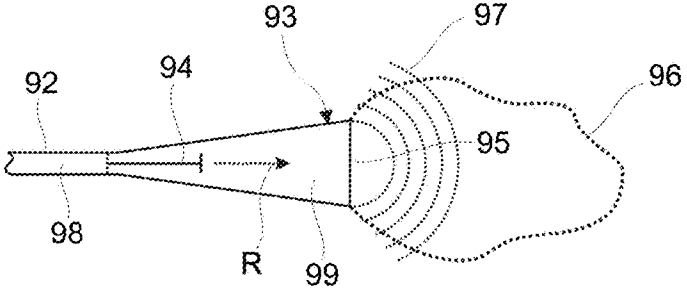
FIG. 3: a further embodiment example of an outlet device.

The cleaning apparatus according to the embodiment example according to FIG. 3 comprises an outlet device in the form of a diffuser 93 with an outlet opening 95. A swirl element 94 is arranged in its centre. The swirl element 94 serves for the additional slowing of the flow and of the intermixing of the explosive mixture entering the diffuser 93 from the feed pressure conduit 92. The swirl element 94 is fixed in the feed pressure conduit 92. The swirl element 94 comprises a platelet-like component that is arranged transversely to the outflow direction R (see also FIG. 1).

The diffuser 93 also forms a receiving space 99 for a part of the introduced explosive mixture. Another part of the gaseous mixture flows outwards via the diffuser 93 and forms the cloud 96.

The outlet device according to FIG. 3 and the operation of this can alternatively be configured such that only the receiving space 99 of the diffuser 93 is filled with an explosive mixture and made to explode. The explosion pressure waves 97 propagate departing from the outlet opening 95. No cloud is produced outside the diffuser 93 in this case. The explosion pressure waves 97 and the cloud 96 in FIG. 3 accordingly represent alternative representations.

The cleaning device 81 according to the embodiment example according to FIG. 4 comprises a cleaning apparatus with an outlet device 83, which is designed in the form of a truncated icosahedron. This comprises a plurality of outlet bodies in the form of diffusers 84 that represent funnel-like widenings. The diffusers are directed radially outwards from a centre. The outlet openings 85 are arranged in a radially outwardly directed manner. The feed pressure conduit 82 with the feed pressure channel 88 for the explosive mixture runs to the centre of the icosahedron-shaped outlet device 83, from where the explosive mixture is led into the funnel-like widenings 84.

Figure 5:
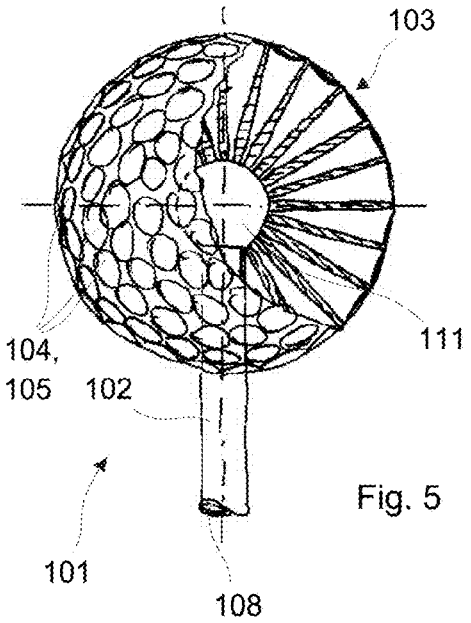
FIG. 5: a further embodiment example of an outlet device.

The outlet device 103 of the cleaning apparatus 101 according to the embodiment example according to FIG. 5 is designed in a spherical manner. It comprises a plurality of outlet bodies in the form of diffusers 104, which are designed as funnel-like widenings. The diffusers are directed radially outwards from a centre. The outlet openings 105 are arranged in a radially outwardly directed manner.

The feed pressure conduit 102 with the feed pressure channel 108 for the explosive mixture runs to the centre of the spherical outlet device 103 and runs out in a central spherical distribution space 111, from where the explosive mixture is led via openings in the peripheral region of the spherical distribution space 111, radially outwards into the funnel-like widenings 104. Flow guidance elements can be arranged in the spherical distribution space 111 (not shown).

The diameter of the feed pressure channel 108 can e.g. be 15 to 30 mm or more, in particular 20 to 25 mm, such as 21 mm.

Figure 6:
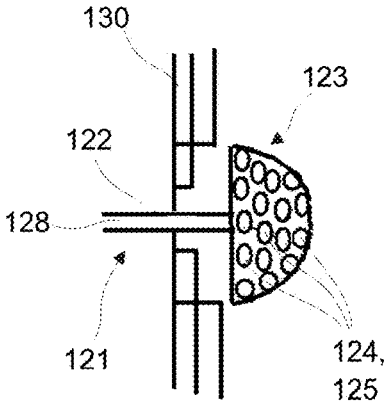
FIG. 6: a further embodiment example of an outlet device.

The outlet device 123 of the cleaning apparatus 121 according to the embodiment example according to FIG. 6 is constructed similarly to the outlet device 103 according to the embodiment example according to FIG. 5. The present outlet device 123, however, is designed merely in a hemispherical manner. It likewise comprises a plurality of outlet bodies in the form of diffusers 124, which are designed as funnel-like widenings. The diffusers are directed radially outwards from a centre. The outlet openings 125 are arranged in a radially outwardly directed manner.

A decomposition of the cloud cannot take place in the boundary region toward the wall since the hemispherical outlet device in particular is arranged on the wall. The hemispherical outlet device can comprise a peripheral collar for achieving the same effect, in the case that the hemispherical outlet opening is applied at a distance to the wall.

The feed pressure conduit 122 with the feed pressure channel 128 for the explosive mixture runs out at the flat side of the hemispherical outlet device 123 in the central position into this outlet device 123, from where the explosive mixture is led into the funnel-like widenings 124. The outlet device 123 in combination with the feed pressure conduit 122 is designed in a mushroom-like manner. The flat side of the outlet device 123 is directed to the wall 130 of the receptacle or installation. The outlet device 123 can be sunk or recessed in the wall 130.

The outlet devices according to the FIGS. 4, 5 and 6 permit a spatial exit of the explosive mixture in all directions. This encourages or assists the formation of a cloud in the interior of the receptacle or installation, since the explosive mixture is distributed uniformly in the space.

The outlet speed of the explosive mixture at the outlet openings of the diffusers can be even be greater compared to the single diffuser according to FIGS. 1 and 2. Thus, the diffusers with respect to the ratio of the length to opening diameter can be designed in a shorter manner than those according to FIGS. 1 and 2. Their opening angle can also be likewise designed smaller.

The reason for this is that the individual diffusers with the exception of the end-side diffusers are surrounded by adjacent diffusers, from which the explosive mixture is likewise discharged in each case. A lateral mixing-in of the surrounding atmosphere is no longer possible at all on account of this.

No swirling or eddy formation between the individual exiting gas flows is to be expected since the explosive mixture moreover is discharged through all diffusers preferably at the same or similar speed. The explosive mixture, which flows out in a surfaced manner in contrast displaces the surrounding atmosphere in the outflow direction. This, moreover, also relates to the embodiment examples according to FIGS. 10 to 13.

Figure 7:
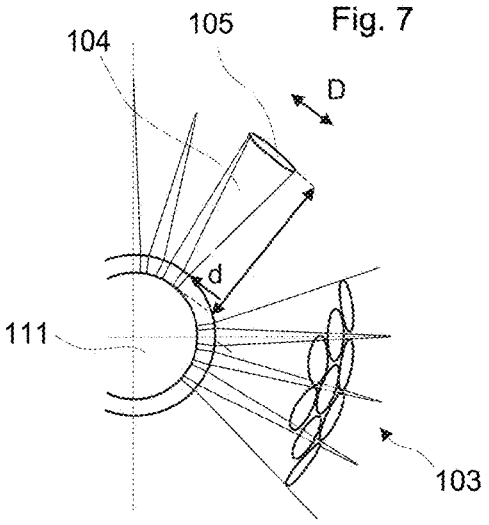
FIG. 7: a schematic representation of one aspect of the outlet device according to FIG. 5.

FIG. 7 shows a schematic sketch of the arrangement of the diffusers 104 according to the embodiment examples according to FIG. 5. The diameter D of the outlet opening can e.g. be 5 to 20 mm, in particular 10 to 15 mm, such as 13 mm. The diameter d of the diffuser 104 at its narrowest location at the beginning of the funnel-like widening can, for example, be 1 to 5 mm, in particular 1 to 2 mm, such as 1.5 mm. The length L of the diffuser 104 up to the run-out in the central space of the outlet device 123, for example, is 30 to 50 mm, in particular 35 to 45 mm, such as 39 mm. The ratio $D^2:d^2$ can e.g. be 75 or less. The specified dimensions and ratios are preferably also valid for the embodiment example according to FIG. 6.

FIG. 8*a* shows the outlet device 143 of a cleaning apparatus 141, into which the explosive mixture flows via the feed pressure channel 148 of a feed pressure conduit 142. The outlet opening 143 forms a receiving space 147 for at least a part of the introduced explosive mixture. In contrast to the embodiment example according to FIGS. 1 to 3, the outlet device 143 comprises laterally arranged outlet openings 145. For this, a funnel-like base body 144 with its widened cross section runs out into an outlet body which is arranged transversely to this and which is likewise widened in a funnel like manner towards both outlet openings 145 in each case. Accordingly, the explosive mixture flowing axially in through the base body 144 is deflected to the lateral outlet openings 145 by about 90° (angle degrees) (see arrows). The base body or the outlet bodies as a result are designed as diffusers. The explosive mixture forms a cloud 146 outside the diffusers.

The outlet device 163 of a further cleaning apparatus 161 which is shown in FIG. 8 likewise comprises a funnel-like base body 164, into which the explosive mixture flows via the feed pressure channel 168 of a feed pressure conduit 162. Here too, the outlet device 163 forms a receiving space 167 for at least a part of the introduced explosive mixture. The outlet device 163 moreover likewise comprises laterally arranged outlet openings 165. For this, the funnel-like base body 164 with its widened cross section runs out into an outlet body, which is arranged transversely to this and which is likewise widened in a funnel-like manner in each case to both outlet openings 165. The base body 164 comprises a flow guidance wall 170, which divides the flow of explosive mixture led in the direction of the outlet bodies, to the two outlet openings 165. The flow is likewise deflected to the two lateral outlet openings 165 by about 90° (see arrows). Here too, the base bodies or the outlet bodies are designed as diffusers. The explosive mixture forms a cloud 166 outside the diffusers.

The outlet devices according to FIGS. 8*a* and 8*b* in particular have the advantage that reduced or no repulsive forces occur thanks to the lateral exit of the explosive mixture.

FIG. 9*a* shows a cleaning apparatus 341 with an outlet device 343 of a construction type that is similar to the outlet device according to FIG. 8*a*. The explosive mixture flows via the feed pressure channel 348 of a feed pressure conduit into the outlet device 343. The outlet device 343 forms a receiving space for the introduced explosive mixture. The outlet device 443 comprises laterally arranged outlet openings 345. For this, a base body 344 with a cross section that is widened with respect to the feed pressure conduit runs out into an outlet body 349 arranged transversely to this. The outlet body 349 in each case has a funnel-like widening to the outlet openings 345, which lie opposite one another.

The explosive mixture is ignited in the receiving space 347. The explosion pressure waves 346 are deflected towards the lateral outlet openings by 90° (angle degrees) and propagate laterally departing from the outlet openings 345.

FIG. 9*b* shows a cleaning apparatus 441 with an outlet device 443 of a construction type that is similar to the outlet device according to FIG. 8*b*. The outlet device 443 comprises a base body 444, into which the explosive mixture flow via the feed pressure channel 448 of a feed pressure conduit. Here too, the outlet device 443 forms a receiving space 447 for at least a part of the introduced explosive mixture. The outlet device 443, moreover, likewise comprises laterally arranged outlet openings 445. For this, the base body 444 with its cross section, which is widened with respect to the feed pressure conduit, runs out into an outlet body 449, which is arranged transversely to this and which is likewise widened in a funnel-like manner to both outlet openings 445.

The explosive mixture is ignited in the receiving space 447. The explosion pressure waves 446 are deflected to the lateral outlet openings 445 by about 90° (angle degrees) and propagate laterally departing from the outlet openings 445.

The outlet devices according to FIGS. 9*a* and 9*b* in particular have the advantage that reduced or no repulsive forces occur thanks to the lateral exit of the explosion pressure waves.

Figure 10:
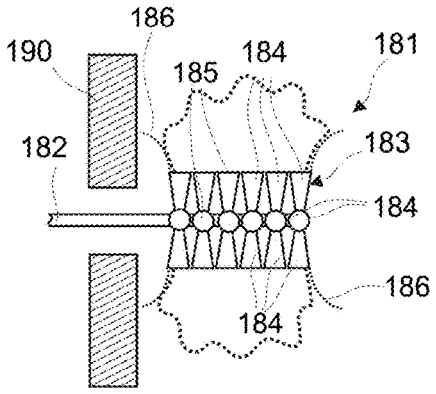
FIG. 10: a further embodiment example of an outlet device.

The outlet device 183 according to FIG. 10 and which is introduced through an opening in the wall 190 of a receptacle or installation is formed from the end section of the feed pressure conduit 182, on the outer periphery of which end section a plurality of outlet bodies in the form of funnel-like diffusers 184 with outlet openings 185 lead away radially in different spatial directions. The feed pressure conduit 182 comprises suitable opening, which run out into the diffusers 184. The diffusers 184 are arranged annularly around the feed pressure conduit 182 as well as successively in the longitudinal direction of the feed pressure conduit. They form a cylinder-shaped outlet device 183.

A shielding element 186 can be arranged in each case at the front and rear axial end of the outlet device 183 and this at the front and rear axial end of the outlet device 183 considered in the exit direction shields the explosive mixture exiting from the outlet bodies 184, to side, so that no decomposition of the cloud by mixing can take place in this boundary region.

The shielding elements 186 form a type of funnel-like widening subsequent to the outlet area formed by the formed by the outlet opening 185. The shape of the shielding elements 186 can also be designed differently than that shown.

Moreover, one can also envisage outlet bodies with an axial direction component likewise being arranged at the front end of the outlet device. The outlet openings of the outlet bodies can, for example, form a hemispherical outlet surface, as is shown in the embodiment example according to FIG. 6.

Figure 11:
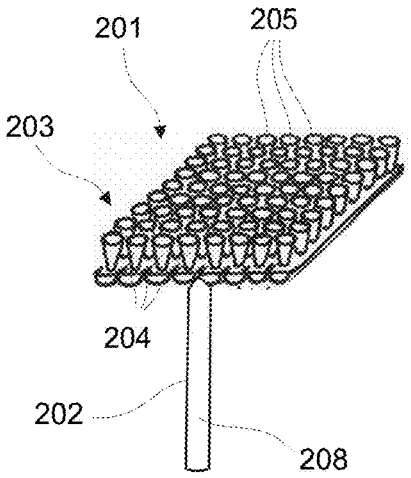
FIG. 11: a further embodiment example of an outlet device.

The outlet device 203, which is show in FIG. 11, has a diffuser field. This consists of a multitude of outlet bodies that are arranged next to one another and that are in the form of funnel-like diffusers 204, which are equally aligned. In the present embodiment example, the outlet openings 205 lie in a common plane, which however is not essential. The outlet openings 205 form a plane outlet surface.

The outlet device 203 in particular is suitable for the installation onto or into a wall. The outlet device 203 can, for example, be sunk or recessed in the wall, wherein the outlet openings 205 are flush with the wall.

The cleaning apparatus 221, which is shown in FIG. 12, comprises an outlet device 223. This comprises a plurality of outlet bodies in the form of funnel-like diffusers 224 with outwardly directed outlet openings 225, and these outlet bodies are arranged along the periphery of the feed pressure conduit 222 and lead radially away from this conduit. The diffusers 224 lie in a common plane and form a disc-like arrangement on account of this.

Figures 12A, 12B, 12C:
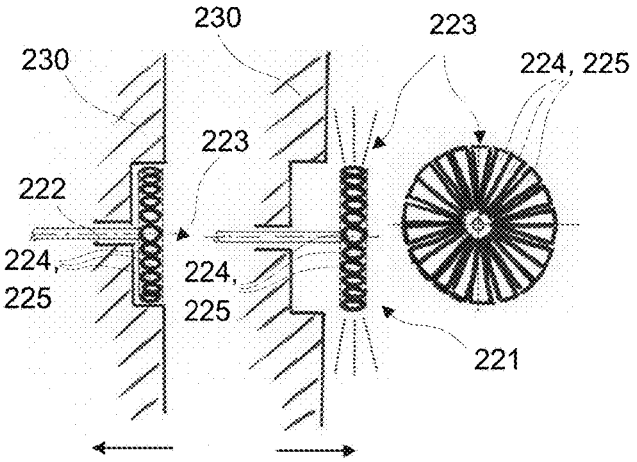
FIGS. 12*a*,12*b*,12*c*: a further embodiment example of an outlet device.

A recess or deepening, which corresponds to the diffuser arrangement and into which the disc-like diffuser arrangement can be stowed away, embedded or sunk (see FIG. 12*a*) by way of retracting (arrow direction) the outlet device 203, can be provided in the wall 230 of the receptacle or installation. The disc-like diffuser arrangement is extended out of the recess into the space of the receptacle or installation (arrow direction) (see FIG. 12*b*), for assuming the working position. FIG. 12*c* moreover shows a plan view of the diffuser arrangement of the outlet device 203.

The cleaning apparatus 221 in particular is suitable for cleaning the wall 230, on which this is arranged. The explosion pressure produced by the cleaning apparatus 221 creates a shear effect upon the contamination sticking to the wall 230.

Figure 13:
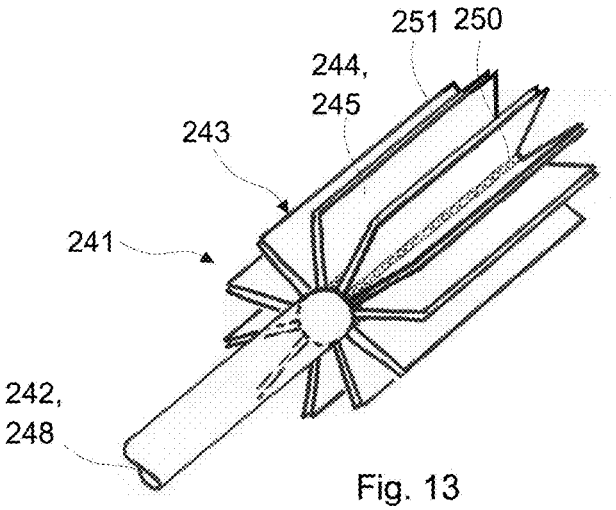
FIG. 13: a further embodiment example of an outlet device.

The cleaning apparatus 241, which is represented in FIG. 13, comprises an outlet device 243. This, similarly to a rotary feeder comprises partition walls 251, which project radially from the feed pressure conduit 242 and which are arranged parallel to the longitudinal direction of the feed pressure conduit 242. Two adjacent partition walls 251 form an outlet body due to their radial alignment. The outlet body shapes a wedge-like space, which acts as a diffuser 244. Openings 250, which run out into the wedge-like space between the partition walls 251, are provided in the feed pressure conduit 242. The explosive mixture flows through these openings 250 into the wedge-like diffuser space and is calmed in this, before the mixture escapes outwards through the slot-like outlet opening, which is formed between two partition walls.

According to this embodiment example, the cleaning-side end section of the feed pressure conduit 242 forms the distribution or manifold space.

As a modification of the embodiment example according to FIG. 13, one can also envisage outlet bodies, which, for example, are designed as diffusers, being arranged between the partition walls. These are preferably arranged next to one another in a row and are connected to openings of the feed pressure conduit. The partition walls extend radially past the outlet openings of the outlet bodies. The same result would be achieved if partition walls leading radially away from the feed pressure conduit 182 were to be arranged between the rows of diffusers 184 according to the embodiment example 183.

The partition walls provide additional protection in the case of a strong flow in the atmosphere of the surroundings. The cloud can therefore be formed in a protected manner and ignited, between the partition walls. The partition walls are not deformed, even if these are designed in a comparatively thin-walled manner, since the explosion pressure is built up on both sides of the partition walls in each case, given an explosion.

The outlet device according to the embodiment examples according to FIGS. 3 to 13 can, for example, be attached on a cleaning-side end section of a cleaning lance which is described above.

Figure 14:
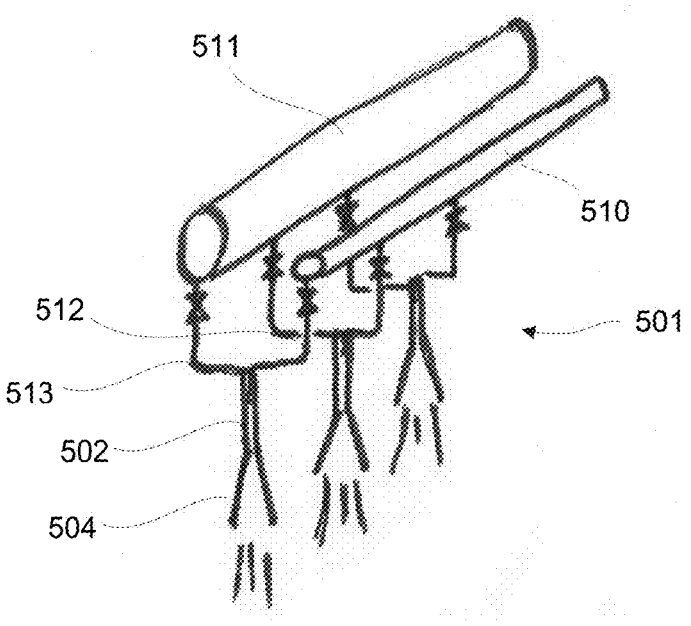
FIG. 14: a schematic representation of a feed solution for an outlet device according to the invention.

According to the conceptional representation of a cleaning device 501, which is represented in FIG. 14, several diffusers 504 are fed with the explosive mixture in each case through separate feed pressure conduits 502. The individual gaseous components of the mixture are fed from a respective common pressure container 510, 511 to the individual diffusers 504 or their feed pressure conduits 501 via suitable feed conduits 512, 513.

Figure 15:
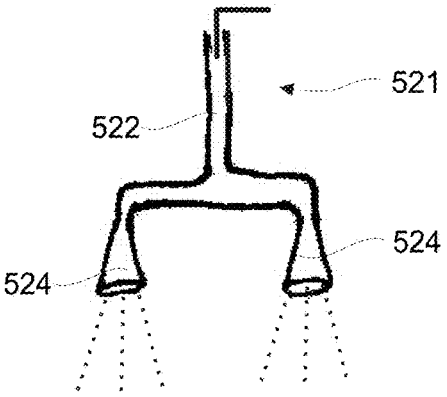
FIG. 15: a schematic representation of a further feed solution for an outlet device according to the invention.
Figure 16:
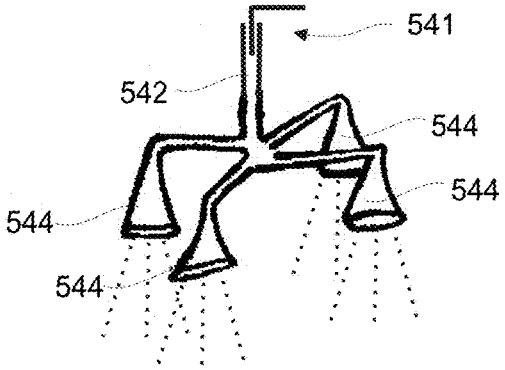
FIG. 16: a schematic representation of a further feed solution for an outlet device according to the invention.

According to the conceptual representation of a cleaning device 521, 541 which is represented in FIGS. 15 and 16, several diffusers 524, 544 are supplied with the explosive mixture via a collective feed. The diffusers 524 for this are fed through a common feed pressure conduit 522, which branches to the individual diffusers 524, 544.

The embodiments according to FIGS. 15 and 16 can be combined with the embodiment according to FIG. 14. In other words, the feed pressure conduit 501 can branch and feed several diffusers, instead of a single diffuser 504 according to FIG. 14.

Figure 17B:
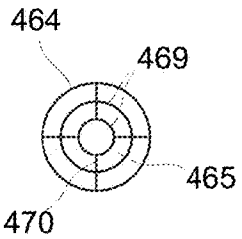
FIG. 17*b*: a front view of the outlet device according to FIG. 17*a;*
Figure 17A:
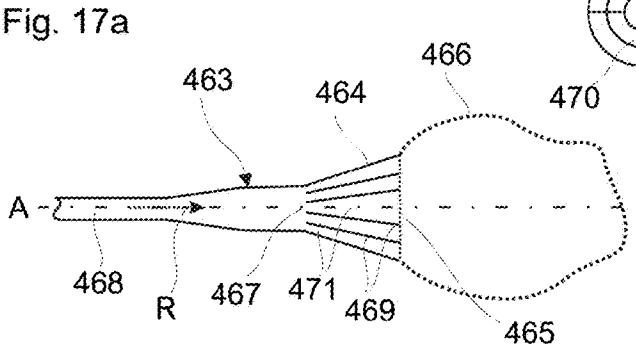
FIG. 17*a*: a cross-sectional view of a further embodiment example of an outlet device.

FIGS. 17*a* and 17*b* show a further embodiment of an outlet device 463 of a cleaning apparatus with an outlet opening 465. The outlet device 463 towards the outlet opening 465 forms a diffuser in the form of a funnel-like widening. The outlet device 463 with the diffuser also forms a receiving space 467 for a part of the introduced explosive mixture. Another part of the gaseous mixture is calmed in the diffuser and flows outwards via the outlet opening 465 and forms the cloud 466.

Annular flow guidance elements 469, which in each case likewise form a funnel-like widening towards the outlet opening 465 are arranged in the funnel-like widening of the diffuser. An annular flow channel 471 is formed between the outer wall of the diffuser and the flow guidance element 469 or between the flow guidance elements 469. This flow channel towards the outlet opening 465 likewise has a conical widening. The annular flow channel 417 is interrupted by radially arranged connection webs 470, which connect the flow guidance elements 469 amongst one another and to the outer wall of the diffuser. The flow guidance elements 469 likewise contribute to the calming and uniformity of the flow. The number of flow guidance elements 469 can vary.

The flow guidance elements 469 can have an angle increasing from the inside to the outside with respect to a longitudinal axis A. In the present shown embodiment example, this angle increases outwards in steps of 10° (angle degrees). The innermost flow guidance element 469, for example, has an angle of 10° with respect to the longitudinal axis A, the second outermost flow guidance element 469 an angle of 20° and the outer wall an angle of 30°.

FIG. 18 shows a special design of the cleaning apparatus 651 in the region of the mixing zone 664. The cleaning apparatus 651 is a cleaning lance with a feed pressure conduit 656 with a feed pressure channel 657. An ignition device 668 is provided on the feed pressure conduit.

A metering (dosing) device 654 is arranged on the feed-side end section. The metering device 654 comprises a gas lead pipe 658, also called outer pipe, and an inner pipe 659. The inner pipe 659 forms a first introduction channel 652, via which a combustible gaseous component is introduced into the feed pressure channel 657. The latter component is introduced into the first introduction channel 652 via metering valves 663, and this is only shown by way of example.

An annular, second introduction channel 653, via which gaseous oxygen or an oxygen-containing gaseous component is introduced into the feed pressure channel 657 of the feed pressure conduit 656 is formed between the gas lead pipe 658 and the inner pipe 659.

The inner pipe 659 ends within the gas feed pipe 658. The second annular introduction channel 653 merges into the feed pressure channel 657 at this location. A mixing zone 664, in which the gaseous components flowing out of the first and second introduction channel 652, 653 into the common feed pressure channel 657 mix with one another, is formed in this region.

A reduction of the cross section is provided in the region of the inner pipe end. This reduction is such that the cross section of the second, annular introduction channel 653 conically narrows towards the inner pipe end. The narrowing is moreover of such a nature than the cross section of the feed pressure channel 657 conically increases in the feed direction R subsequently to the inner pipe end. The inner pipe end lies in the region of the cross section that increases again in the feed direction R. The narrowest location is arranged behind the inner pipe end.

The geometric design of the cross-sectional change is such that the cleaning apparatus 651 forms a Laval nozzle in the region of the inner pipe end with suitable flow conditions.

The embodiment of a cleaning lance 601 according to FIGS. 19*a* and 19*b* shows a cleaning lance with a feed-side end section, on which a metering device 604 is formed and with a cleaning-side end section, on which an outlet device 605 is arranged. A feed pressure conduit 606 with a feed pressure channel 607, via which the explosive mixture is delivered from the metering device 604 to the outlet device 605, is arranged between the metering device 604 and the outlet device 605.

The outlet device 605 in the present example is designed as a conical diffuser with an outlet opening. The outlet opening 605 however can also be designed differently.

The cleaning lance can be introduced into the interior of a receptacle to be cleaned, through an opening in the receptacle wall 630.

The metering device 604 comprises a gas lead pipe 608 and an inner pipe 609. The inner pipe 609 forms a first introduction channel 602, via which a combustible, gaseous component is introduced into the feed pressure channel 607. A second, annular introduction channel 603, via which oxygen or an oxygen-containing, gaseous component is introduced into the feed pressure channel 607 of the feed pressure conduit 606, is formed between the gas lead pipe 608 and the inner pipe 609.

The first combustible component is introduced from a first pressure container 621 via several metering valves 612 into the first introduction channel 602. The oxygen or the oxygen-containing component is introduced from the second pressure container 622 via several metering valves 613 into the second introduction channel 603.

The number of metering valves 612, 61 of the first and the second gaseous component is selected such that the ratio of the number of metering valves 612, 613 corresponds to the stoichiometric ratio of the components to be fed. In the present example, the first component is oxygen and the second component ethane. These are introduced in the stoichiometric ratio of 7:2. Accordingly, two metering valves 612 are provided for the first component and seven metering valves 613 for the second component.

The first pressure container 621 is supplied with the respective gaseous component via a first feed conduit 610, and the second pressure container 622 via a second feed conduit 611.

The inner pipe 609 ends within the gas feed pipe 608. The second annular introduction channel 603 merges into the feed pressure channel 607 at the inner pipe end. A mixing zone 614 is formed in this region, in which mixing zone the gaseous components flowing from the first and the second introduction channel 602, 603 into the common feed pressure channel 607 are mixed with one another. The cross section of the feed pressure channel 607 undergoes a funnel-like widening in the mixing zone.

An ignition device 668 for igniting the explosive mixture is provided on the feed pressure conduit 656. A control device 617 is connected to the ignition device 668 as well as the metering valves 612, 613 via control leads 619. The control leads 619 are also to represent a wireless connection. The opening and closure of the metering valves 612, 613 as well as the activation of the ignition device are effected via the control device 617.

The invention claimed is:

1. A method for removing deposits in interiors of receptacles or installations by way of explosion technology, comprising the steps of:

providing a cleaning device comprising a longitudinal component with a feed pressure conduit and an outlet device, said outlet device being fluidly connected to the feed pressure conduit and comprising a diffuser having at least one outlet opening, wherein a cross-section of the diffuser gradually enlarges as said diffuser extends from said feed pressure conduit toward said at least one outlet opening so that gas flowing into said diffuser from said feed pressure conduit expands and slows while moving through said diffuser toward said at least one outlet opening, introducing the longitudinal component with said diffuser into the interior of the receptacle or installation;

introducing gaseous components into the longitudinal component;

providing a gaseous, explosive mixture comprising the gaseous components, in the feed pressure conduit, said gaseous, explosive mixture flowing through the feed pressure conduit and into the outlet device and diffuser, wherein the feed pressure conduit and the outlet device, including the diffuser, form a receiving space that receives the gaseous, explosive mixture;

igniting the gaseous, explosive mixture in a controlled manner in the feed pressure conduit with an ignition device arranged in the feed pressure conduit, exploding the gaseous, explosive mixture and thus removing deposits from walls in the interior of the receptacle or installation, wherein the gaseous, explosive mixture is introduced into the interior of the receptacle or installation from the receiving space via the outlet opening of the diffuser, and a cloud of gaseous, explosive mixture is formed in the interior of the receptacle or installation such that an edge region of the cloud is in direct contact with a surrounding atmosphere, wherein a volume of the gaseous, explosive mixture in the receiving space and a volume of the cloud of the gaseous, explosive mixture establish a total volume of the gaseous, explosive mixture, and wherein the total volume of gaseous, explosive mixture is produced and made to explode in a controlled manner in a time period of less than one second.

2. The method according to claim 1, wherein the receiving space is open to an outside via the at least one outlet opening during introduction of the gaseous components therein as well as during the ignition and explosion of the gaseous, explosive mixture.

3. The method according to claim 1, wherein the total volume of the gaseous, explosive mixture is produced and made to explode in a controlled manner, in a time period of less than 0.5 seconds.

4. The method according to claim 1, wherein the introduction of the gaseous components is effected from at least one pressure container via at least one metering fitting, and a residual pressure of the gaseous components in the at least one pressure container is above ambient pressure after completion of the introduction of the gaseous components.

5. The method according to claim 1, wherein at least two gaseous components are separately introduced into the cleaning device, and a mixing zone, in which the gaseous components are mixed into the gaseous, explosive mixture, is formed in the cleaning device.

6. The method according to claim 1, wherein for forming the total volume of gaseous, explosive mixture, the gaseous components are introduced via at least one metering fitting into the cleaning device at such a speed that the gaseous, explosive mixture in the feed pressure conduit forms a pressure front, which constitutes a boundary between the gaseous, explosive mixture behind the pressure front and ambient atmosphere in front of the pressure front.

7. The method according to claim 1, wherein an explosion pressure wave, which moves in the direction of the outlet opening and which effects an expulsion of gaseous explosive mixture in front of the explosions pressure wave through the at least one outlet opening, is produced with ignition of the gaseous, explosive mixture in the feed pressure conduit, and thereby the cloud of explosive mixture is formed or formulation of the cloud is completed.

8. The method according to claim 6, wherein the gaseous, explosive mixture has an overpressure behind the pressure front considered in a direction of flow of the gaseous, explosive mixture.

9. The method according to claim 6, wherein the gaseous, explosive mixture, considered in a direction of flow of the gaseous, explosive mixture, has a greater density behind the pressure front as compared to in front of the pressure front.

10. The method according to claim 7, wherein exploding the gaseous, explosive mixture in the feed pressure conduit is transmitted onto the cloud outside the outlet device.

* * * * *